US009464463B2

(12) United States Patent
Bao et al.

(10) Patent No.: US 9,464,463 B2
(45) Date of Patent: Oct. 11, 2016

(54) COMBINATION LOCK

(71) Applicant: Shanghai Saintsung Polytron Technologies Inc., Shanghai (CN)

(72) Inventors: Chengfan Bao, Shanghai (CN); Xiuzhi Zhang, Shanghai (CN)

(73) Assignee: Shanghai Saintsung Polytron Technologies Inc., Shanghai (CN)

( * ) Notice: Subject to any disclaimer, the term of this patent is extended or adjusted under 35 U.S.C. 154(b) by 103 days.

(21) Appl. No.: 13/916,574

(22) Filed: Jun. 12, 2013

(65) Prior Publication Data

US 2014/0366592 A1 Dec. 18, 2014

(51) Int. Cl.

*E05B 67/22* (2006.01)
*E05B 37/10* (2006.01)
*E05B 47/00* (2006.01)

(52) U.S. Cl.

CPC ..... *E05B 67/22* (2013.01); *E05B 37/10* (2013.01); *E05B 2047/0083* (2013.01); *Y10T 70/424* (2015.04)

(58) Field of Classification Search

CPC ..... Y10T 70/415; Y10T 70/7316; Y10T 70/459; Y10T 70/7616; Y10T 70/7249; Y10T 70/5022; Y10T 70/7051; Y10T 70/7153; Y10T 70/7181; Y10T 70/7237; Y10T 70/7785; E05B 37/10; E05B 37/08; E05B 37/025

USPC ..... 70/38 A, 301–304, 308, 322

See application file for complete search history.

(56) References Cited

U.S. PATENT DOCUMENTS 1,920,489 A * 8/1933 Francisco Toscano . E05B 37/10 70/25
3,172,283 A * 3/1965 Jacob Rabinow ..... E05B 37/00 70/129
3,274,811 A * 9/1966 Ethington Paul J ..... E05B 37/0068 70/25
3,447,348 A * 6/1969 Dauenbaugh Robert L ..... E05B 37/00 70/285
3,616,667 A * 11/1971 McGourty ..... E05B 37/163 70/285
4,275,576 A * 6/1981 Miller ..... E05B 37/08 70/303 A
4,358,942 A * 11/1982 Mattson ..... E05B 37/08 70/303 A
4,726,204 A * 2/1988 Peyronnet ..... E05B 37/08 70/286

(Continued)

*Primary Examiner* — Suzanne Barrett
(74) *Attorney, Agent, or Firm* — Raymond Y. Chan; David and Raymond Patent Firm

(57) ABSTRACT

A combination includes a lock body, a shackle having a second leg and a first leg, a lock member provided rotatably within the lock body and a locking element disposed movably within the lock body and provided with the lock member, wherein the first locking element is adapted to be driven by the lock member to do a reciprocating motion between a shackle locking state and a shackle releasing state, wherein when the shackle is at the shackle locking state, the first locking element is driven to engage with the first leg of the shack so as to hold the first leg within the lock body; when the shackle is at the shackle unlocking state, the first locking element is driven to leave from the first leg of the shack so as to enable the first leg to separate from the lock body.

17 Claims, 22 Drawing Sheets

(56) References Cited

U.S. PATENT DOCUMENTS 5,184,491 A * 2/1993 Schittenhelm ..... E05B 37/08 70/278.1
5,417,092 A * 5/1995 Iu ..... E05B 67/063 70/38 A
5,473,919 A * 12/1995 Abner et al. ..... E05B 37/08 70/276
5,881,589 A * 3/1999 Clark et al. ..... E05B 47/0012 70/278.7
6,047,575 A * 4/2000 Larson et al. ..... E05B 47/0012 250/231.14
6,553,801 B2 * 4/2003 Chen ..... E05B 21/066 70/365
6,766,673 B2 * 7/2004 Gast et al. ..... E05B 67/06 70/26
7,694,542 B2 * 4/2010 Loughlin et al. ..... E05B 19/00 70/329
7,712,342 B2 * 5/2010 Loughlin et al. ..... E05B 19/00 70/329
8,047,032 B1 * 11/2011 Liu et al. ..... E05B 37/0096 70/303 A
8,347,674 B2 * 1/2013 Trempala et al. . G07C 9/00309 340/5.7
2005/0217326 A1 * 10/2005 Shao ..... E05B 37/08 70/303 A
2006/0185404 A1 * 8/2006 Hansen ..... E05B 9/084 70/38 A
2006/0283216 A1 * 12/2006 Marcelle et al. .. G07C 9/00182 70/38 A
2007/0126551 A1 * 6/2007 Slevin ..... E05B 67/00 340/5.53
2009/0158792 A1 * 6/2009 Lasaroff ..... E05B 67/24 70/38 A
2010/0194527 A1 * 8/2010 Loughlin et al. ..... E05B 29/00 340/5.6
2010/0300163 A1 * 12/2010 Loughlin et al. ..... E05B 37/08 70/301

* cited by examiner

COMBINATION LOCK

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a combination lock, and more particularly to a combination lock having no keyholes and lock member hidden inside the lock body of the combination lock.

2. Description of Related Arts

A combination lock is a type of padlock, wherein a sequence of numbers or symbols is used to open or unlock the lock. However, the lock code of the combination lock is a combination of the numbers or symbols but not the array of numbers or symbols. Accordingly, there are two types of combination lock, i.e. electronic combination lock and mechanical combination lock. The electronic combination lock generally comprises an electro-magnetic lock assembly or an electronically controlled latch, wherein when an input code entered by a user matches with a preset code, the electro-magnetic lock assembly is automatically actuated in an unlocked position in order to unlock the electronic combination lock. However, the major drawback of the electronic combination lock is that the electronic combination lock must be electrically connected to a power source. In other words, the electronic combination lock will not be operated without any power source. In addition, since the electro-magnetic lock assembly must incorporate with an internal electronic chip and other electronic components, the breaking resistance or tensile strength of the electronic combination is weaker than that of the mechanical combination lock.

The mechanical combination lock generally comprises a plurality of rotating dials individually rotating about an axle to link with a lock bolt, wherein when each of the rotating dials is rotated at a predetermined position, the lock bolt is free to move in order to unlock the mechanical combination lock. Since the user must manually rotate a plurality of outer driving rings one-by-one to rotate the corresponding rotating dials respectively, the operation of the mechanical combination lock is complicated. Therefore, the mechanical combination lock cannot be incorporated with any automatic actuation unit to automatically complete the unlocking operation of the mechanical combination lock.

SUMMARY OF THE PRESENT INVENTION

The invention is advantageous in that it provides a combination lock with a lock core or member, wherein the unlocking process of the lock core/member can be operated automatically. The lock core/member comprises a plurality of driving discs to be rotated consequently and automatically to actuate the lock core/member in an unlocked position.

Another advantage of the invention is to provide a combination lock has at least one rotating disc, for example a driving disc or driven disc, wherein the driving disc and driven disc are hidden inside the lock body of the combination lock to prevent the driving disc and driven disc from being impacted by any external forces at the lock body.

Another advantage of the invention is to provide a combination lock, wherein the combination lock comprises an unlocking member, wherein when each of the notches of the driven discs is aligned with the driving opening, the unlocking member is pushed to fall into the unlocking slot defined by the notches and the driving opening such that a user only rotates the driving portion of the driving shaft in a predetermined manner to unlock the combination lock.

Another advantage of the invention is to provide a combination lock, wherein a key hole for the combination lock comprises is not required by the combination lock to prevent the lock member from being impacted by forces outside the lock body.

Another advantage of the invention is to provide a combination lock, wherein the combination lock comprises a lock member adapted to be rotatably provided in the lock body of the combination lock and a first locking element movably provided in the lock body, wherein the first locking element is adapted to couple with the lock member and be driven to move between a shackle locking state and a shackle releasing state.

Another advantage of the invention is to provide a combination lock, wherein the combination lock comprises a coding wheel for coding the rotary motion of the driving shaft for unlock the combination lock, wherein the coding wheel is hidden inside the lock body of the combination lock such that the combination lock can be unlocked by an automatic unlocking device, and a user is not able to see the coded information corresponding to the rotary motion of the driving shaft for unlock the combination lock.

Accordingly, the lock member comprises a rotating axle, a plurality of rotating discs coaxially coupled at the driving shaft, and a disc moving unit provided between every two of the rotating discs. One of the rotating discs is set as a driving disc to be coaxially affixed at the driving shaft, wherein the rest of the rotating discs are set as driven discs to be coaxially and rotatably coupled at the driving shaft. Each of the rotating discs has a notch formed at a peripheral portion thereof. When the driving shaft is rotated, the rotating discs are rotated consequently via the disc moving units to unlock the lock member. The lock code of the lock member is set by an arc angle of each of the rotating disc combined with a rotatable direction sequence. Accordingly, the disc gaps between every two rotating discs are even.

Two driving pins are provided at two opposed sides of each of the rotating discs, wherein the radial locations of the two corresponding driving pins between two disc surfaces of the corresponding rotating disc are symmetrical. Furthermore, the arc angle between each disc mover and the corresponding notch with respect to the center of the rotating disc must be larger than 0 degree and smaller than 360 degrees) ($360° < a < 0°$.

Another advantage of the invention is to provides a combination lock, wherein the combination lock is a purely mechanical lock and doesn't required any of electricity to run.

Additional advantages and features of the invention will become apparent from the description which follows, and may be realized by means of the instrumentalities and combinations particular point out in the appended claims.

According to the present invention, the foregoing and other objects and advantages are attained by a combination lock, which comprises:

a shackle having a first leg and a second leg;

a lock member; and a first locking element movably coupled with the lock member and adapted to be driven by the lock member to move in a reciprocating manner between a shackle locking state and a shackle releasing state, wherein when the shackle is at the shackle locking state, the first locking element is capable of holding the first leg, when the shackle is at the shackle unlocking state, the first locking element is driven to leave from the first leg of the shack.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
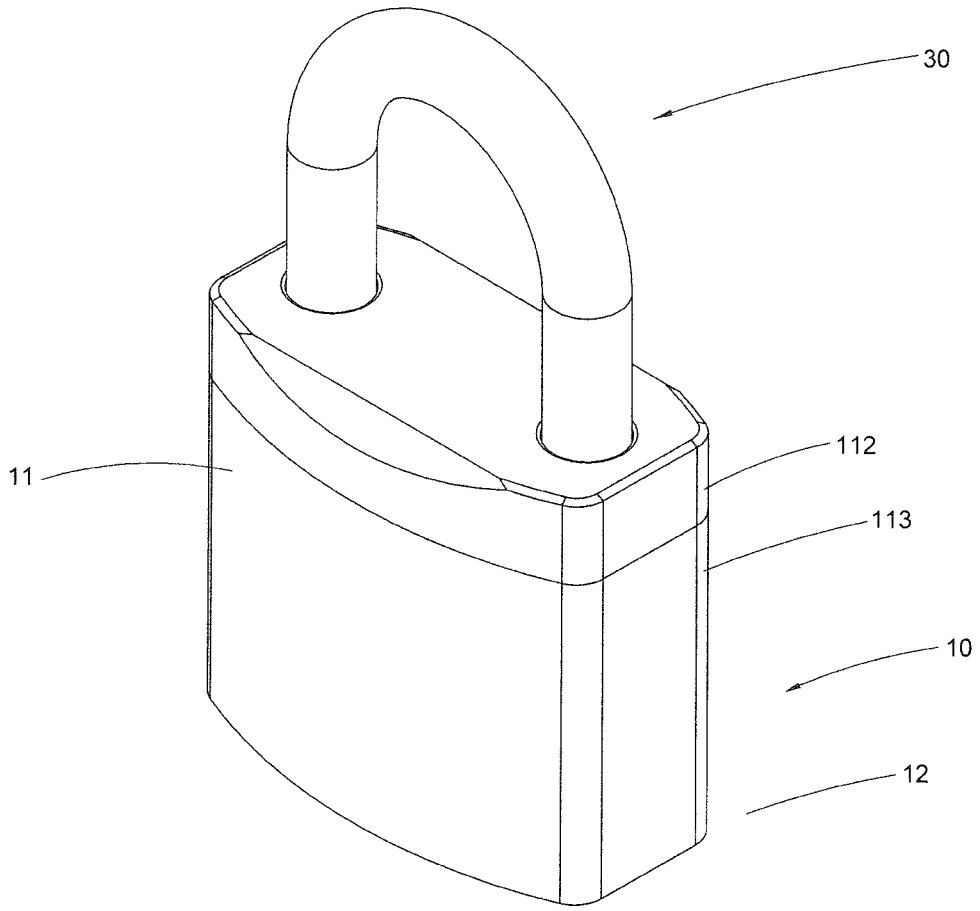
FIG. 1 is a perspective view of the combination lock according to a preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1 to FIG. 19 of the drawings, a combination lock according to a preferred embodiment of the present invention is illustrated. According to the preferred embodiment, the combination lock comprises a lock member 20, a shackle 30 having a first leg 31 and a second leg 32, and a first locking element 40 movably coupled with the lock member 20, wherein the first locking element 40 is adapted to be driven by the lock member 20 to move in a reciprocating manner between a shackle locking state and a shackle releasing state. When the shackle 30 is at the shackle locking state, the first locking element 40 is engaged with the first leg 31. When the shackle 30 is at the shackle unlocking state, the first locking element 40 is driven to release from the first leg 31 of the shackle 30.

As shown in FIG. 1 to FIG. 8, the combination lock further comprises a lock body 10, wherein the lock member 20 is rotatably provided within the lock body 10, and the first locking element 40 is movably provided within the lock body 10. The first locking element 40 is arranged to be engaged with the first leg 31 of the shackle 30 to hold the first leg 31 in the lock body 10 at the shackle locking state and be driven by the lock member 20 to release from the first leg 31 so as to enable the first leg 31 to separate from the lock body 10 at the shackle releasing state.

As shown in FIG. 1 to FIG. 6, the lock body 10 comprises an upper portion 11 and a lower portion 12 downwardly extended from the upper portion 11, wherein the upper portion 11 has a first receiving chamber 110 for receiving the lock member 20 therein.

As shown in FIG. 11A to FIG. 16, the lock member 20 comprises a housing 21 adapted for driving the first locking element 40 to move in order to release the first leg 31 of the shackle 30 from the lock body 10.

The housing 21 of the lock member 20 comprises an upper end 211 adapted for driving the first locking element 40 to move and a lower end 212, wherein the housing 21 defines a second receiving chamber 210. The lock member 20 further comprises an unlocking element 22 pivotally provided between the upper end 211 and the lower end 212 and a disc unit 23 rotatably provided within the second receiving chamber 210, wherein the disc unit 23 comprises a driving disc 231. The driving disc 231 has at least one driving opening 2310 indently formed at a peripheral edge thereof, wherein the driving opening 2310 allows the unlocking element 22 to fit into the driving opening 2310 such that when the driving opening 2310 is aligned with the unlocking element 22, the unlocking element 22 is able to fit into the driving opening 2310 of the driving disc 231 in order to enable the driving disc 231 to drive the unlocking element 22 and the housing 21 of the lock member 20 to rotate.

The driving disc 231 comprises a driving body 2311 and the driving opening 2310 is formed through the driving body 2311 from top to bottom to define a blocking side 23111 and a sliding side 23112 of the driving body 2311, wherein when the unlocking element 22 falls into the driving opening 2310, the unlocking element 22 is adapted to be blocked by the blocking side 23111 and slid along the sliding side 23112 to separate the unlocking element 22 from the driving opening 2310. When the driving disc 231 rotates to enable the blocking side 23111 to move against the unlocking element 22, the driving disc 231 is able to drive the unlocking element 22 and the lock member 20 to rotate. When the driving disc 231 rotates to enable the sliding side 23112 to move against the unlocking element 22, the driving disc 231 is able to push the unlocking element 22 to separate from the driving opening 2310.

Figure 8:
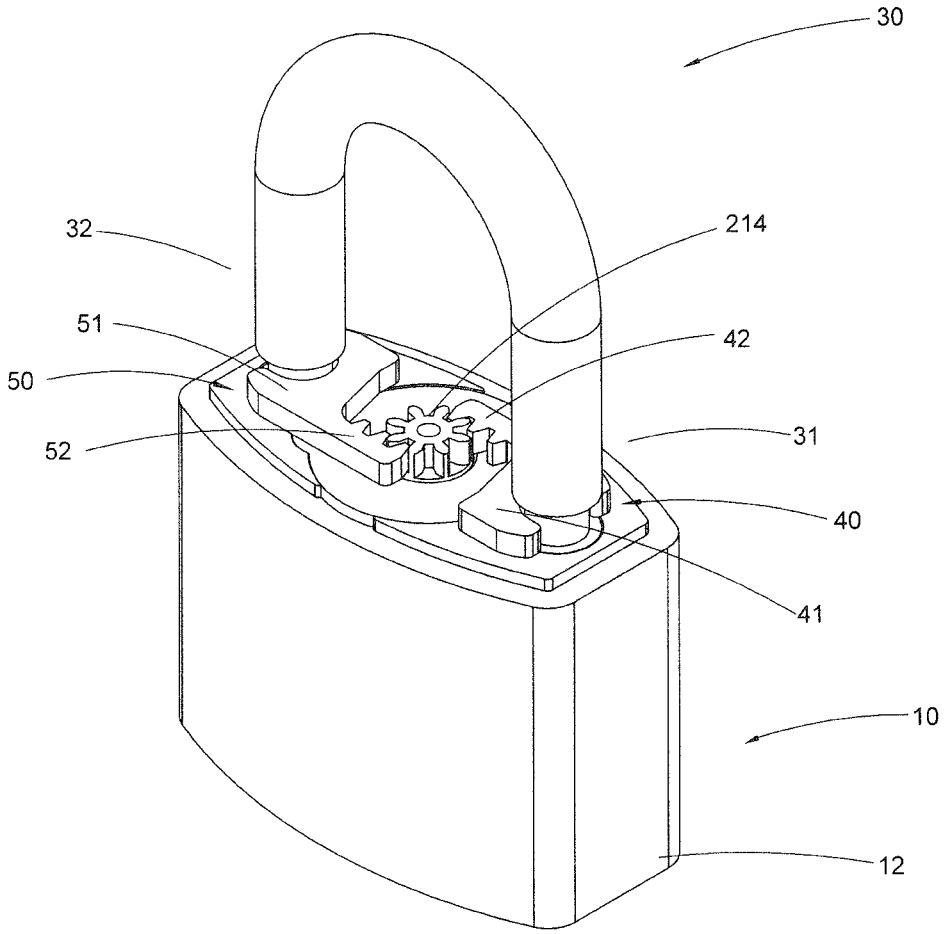
FIG. 8 is a perspective view of the lock body of the combination lock according to the above preferred embodiment of the present invention, wherein the cover body of the lock body of the combination lock is removed.
Figure 9:
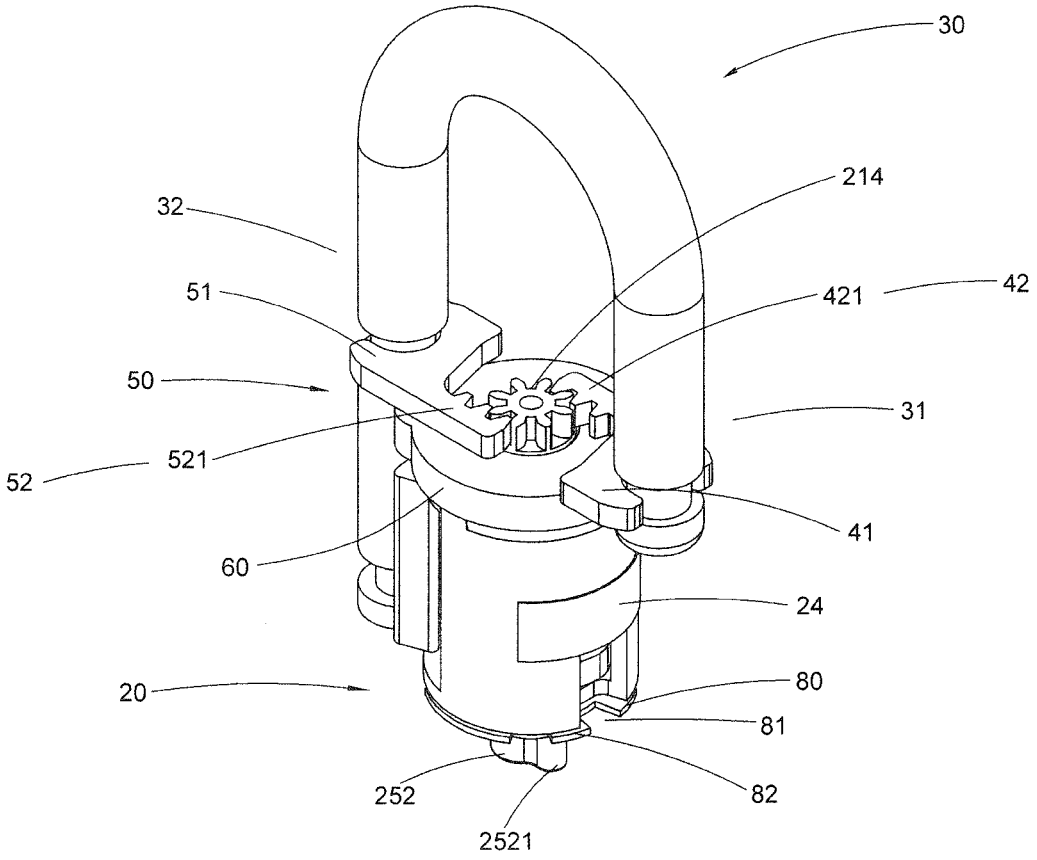
FIG. 9 is a perspective view of the lock body of the combination lock according to the above preferred embodiment of the present invention, wherein the lock body of the combination lock is removed.
Figure 10:
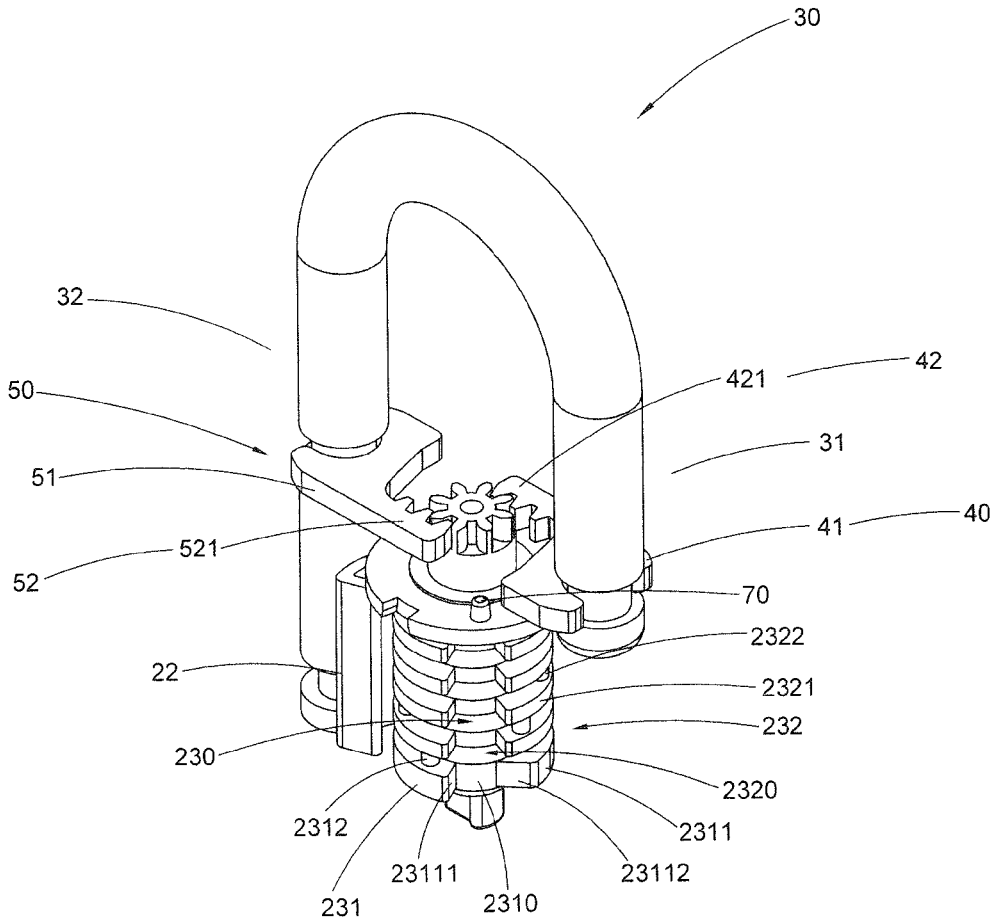
FIG. 10 is another perspective view of the lock body of the combination lock according to the above preferred embodiment of the present invention, wherein the lock body of the combination lock is removed.

As shown in FIG. 8 to FIG. 10, the first locking element 40 comprises a first locking portion 41 adapted to be engaged with the first leg 31 of the shackle 30 and a first driven portion 42 extended from the first locking portion 41 to the lock member 20 and adapted to be driven by the lock member 20 to move the first locking element 40 in a reciprocating manner such that when the lock member 20 rotates, the first driven portion 42 is driven by the lock member 20 to move the first locking element 40 so as to be engaged with the first leg 31 and hold the first leg 31 in the lock body 10 at the shackle unlocking state and drive the first locking portion 41 to leave from the first leg 31 to enable the first leg 31 to separate from the lock body 10 at the shackle unlocking state.

Figure 11A:
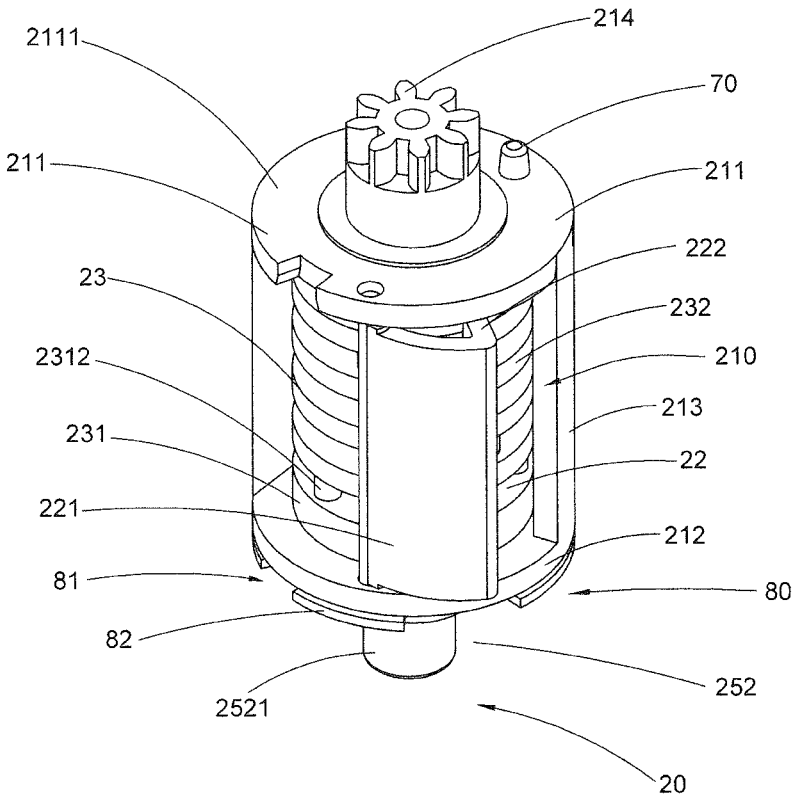
FIG. 11A is a perspective view of the combination unlocking device for a lock according to the above preferred embodiment of the present invention.
Figure 12:
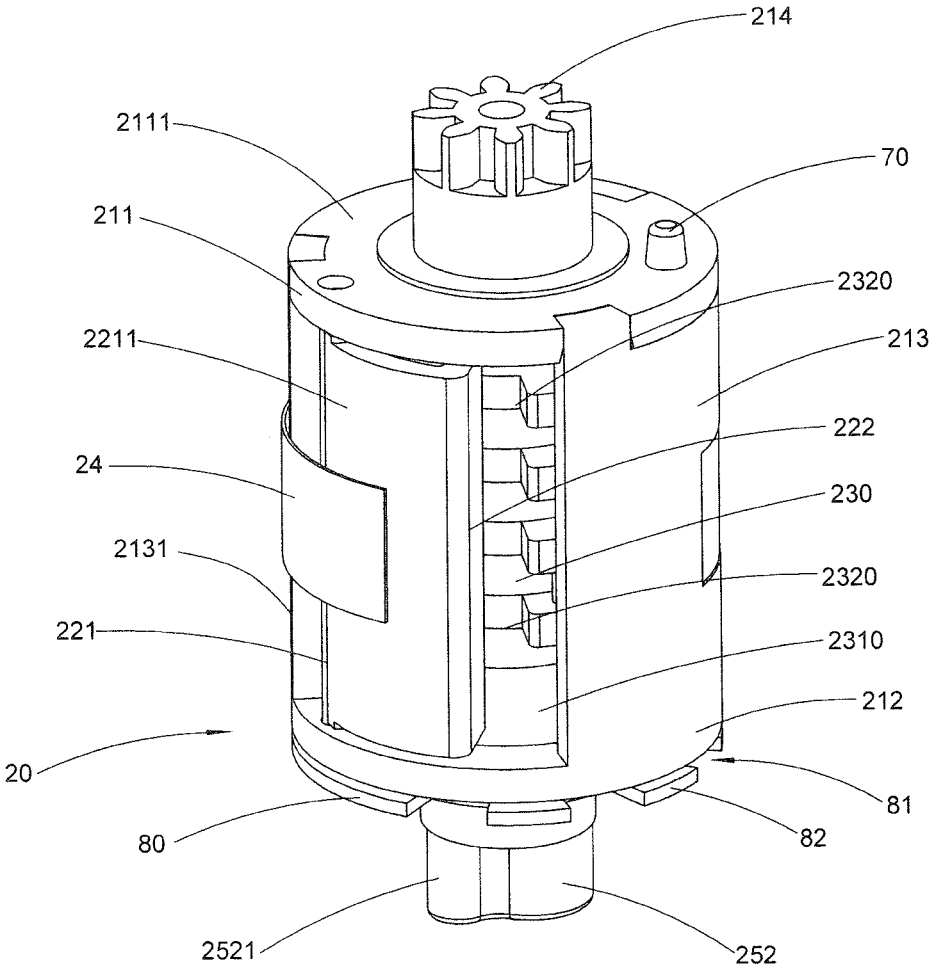
FIG. 12 is a perspective view of the combination unlocking device for a lock according to the above preferred embodiment of the present invention.

As shown in FIG. 9, FIG. 11A, and FIG. 12, the lock member 20 further comprises an elastic element 24. The housing 21 of the lock member 20 further comprises a side wall 213 extended between the upper end 211 and the lower end 212, wherein the side wall 213 defines the second receiving chamber 210 to receive the driving disc 231 therein. The side wall 213 has an outer side 2131, wherein the elastic element 24 is provided on the outer side 2131 of the side wall 213 of the housing 21 and extended from the side wall 213 to the unlocking element 22. When the driving opening 2310 is aligned with the unlocking element 22, the elastic element 24 provides an elastic force to push the unlocking element 22 to fall into the driving opening 2310 in order to enable the driving disc 231 to drive the unlocking element 22 and the housing 21 of the lock member 20 to rotate.

Preferably, the outer side 2131 of the side wall 213 has a curved surface 21311, and the elastic element 24 is an elastic sheet having a corresponding curved shape such that the elastic element 24 is provided along the curved surface 21311 of the outer side 2131 of the side wall 213 of the housing 21.

More preferably, the elastic sheet is a spiral spring sheet, and the unlocking element 22 comprises a positioning portion 221 pivotally provided between the upper end 211 and the lower end 212 and a blocking rib 222 provided with the positioning portion 221 and adapted to fall into the driving opening 2310 of the driving disc 231 and be blocked by the blocking side 23111 of the driving body 2311, wherein the positioning portion 221 has an curved outer surface 2211 and the spiral spring sheet is provided along the curved outer surface 2211 of the positioning portion 221, as shown in FIG. 12.

Figure 13:
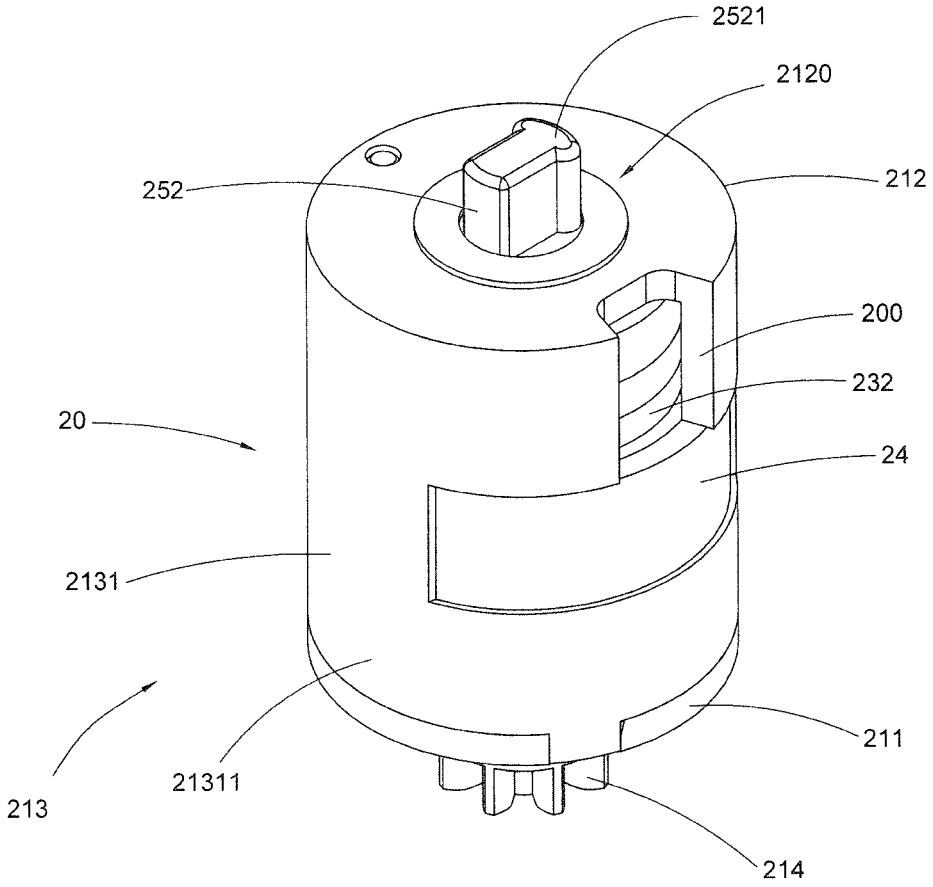
FIG. 13 is a perspective view of the combination unlocking device for a lock according to the above preferred embodiment of the present invention, illustrating the lock member has a laser decline channel for reducing the intensity of the inflected laser.
Figure 14:
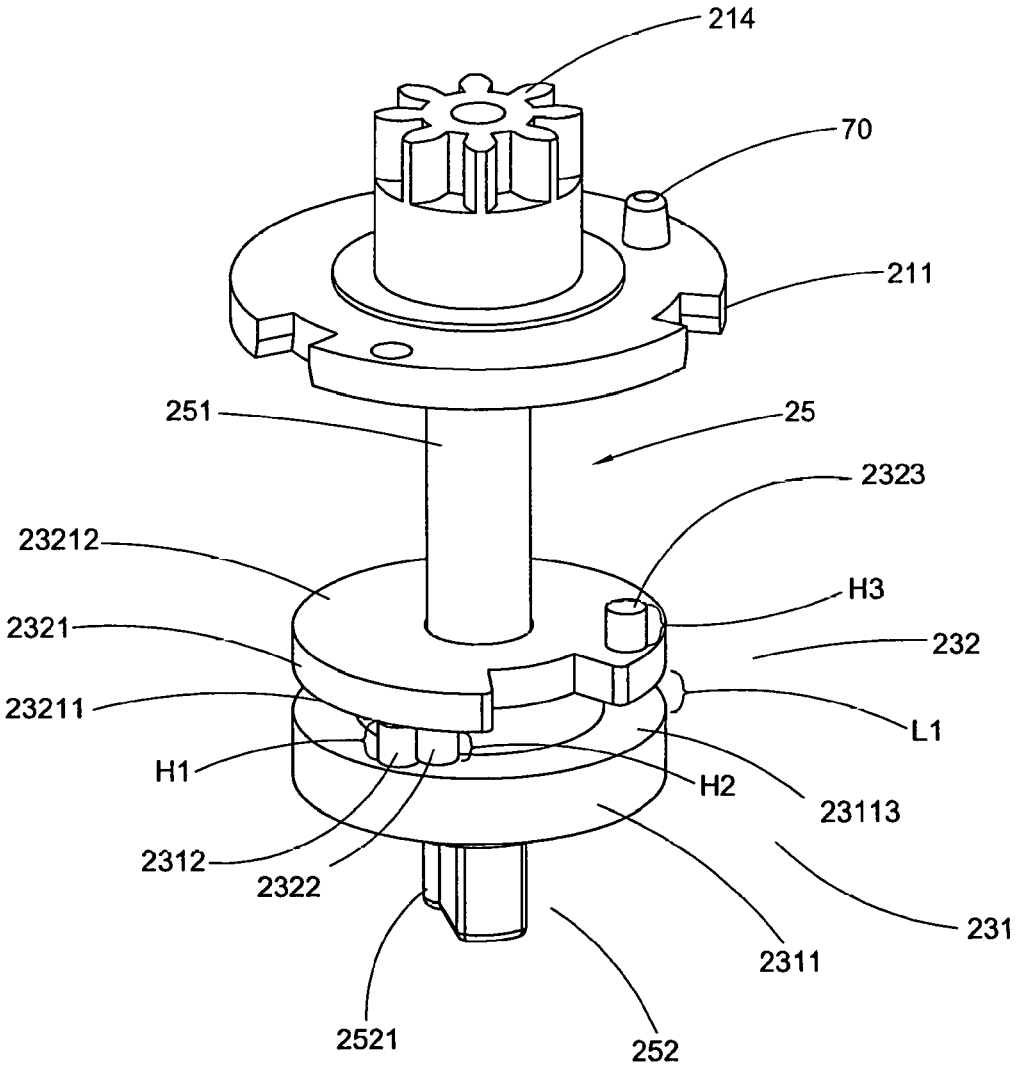
FIG. 14 is a perspective view of the disc unit of the combination unlocking device for a lock according to the above preferred embodiment of the present invention.
Figure 16:
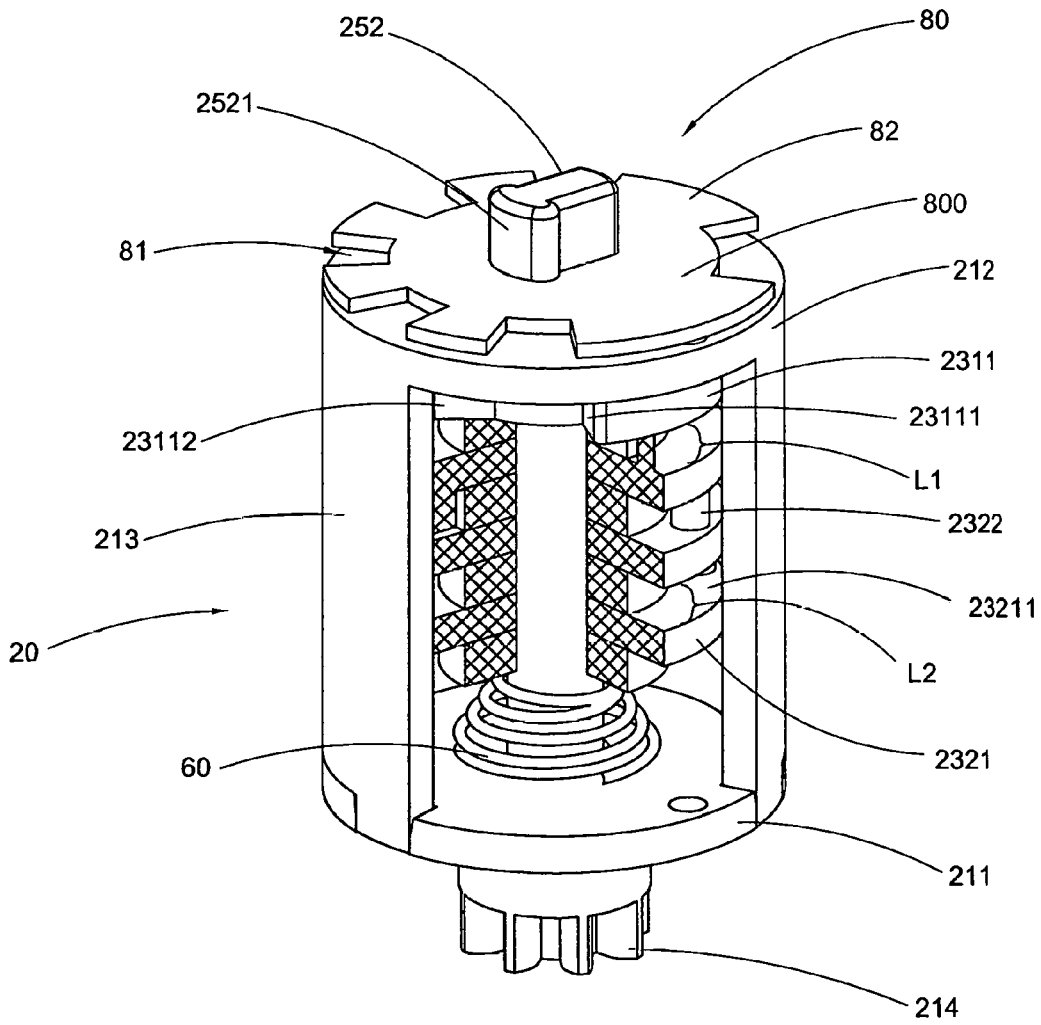
FIG. 16 is a partially sectional view of the coding wheel of the combination lock according to the above preferred embodiment of the present invention.
Figure 17:
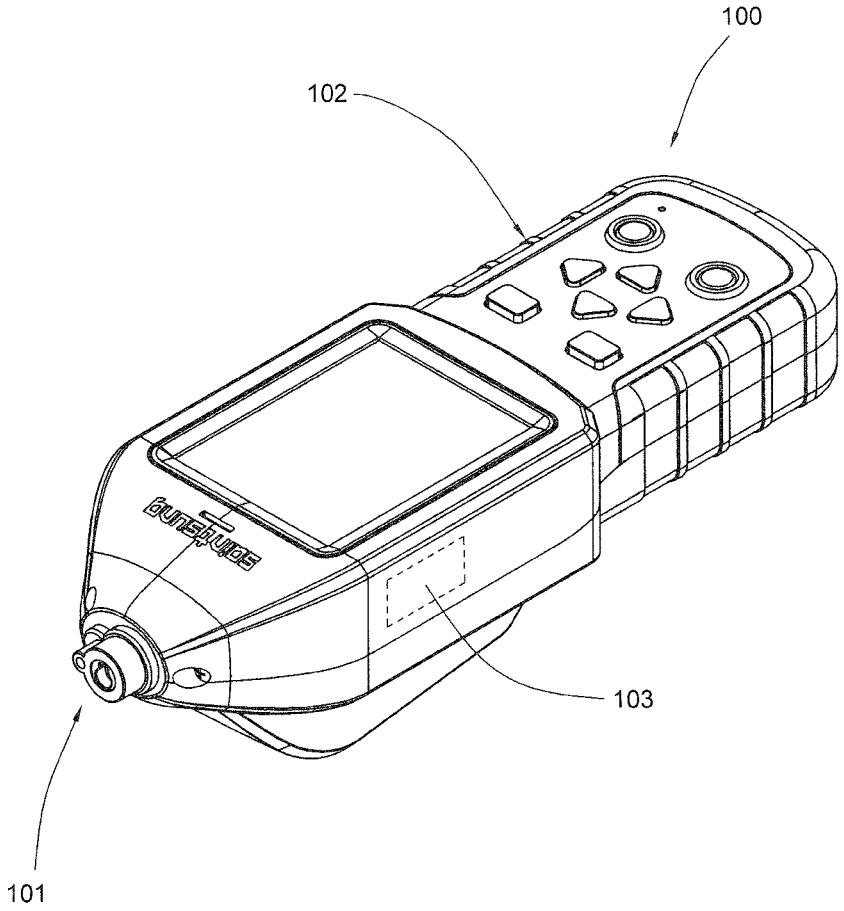
FIG. 17 is a side view of an automatic unlocking device for unlocking the combination lock according to the above preferred embodiment of the present invention.
Figure 18:
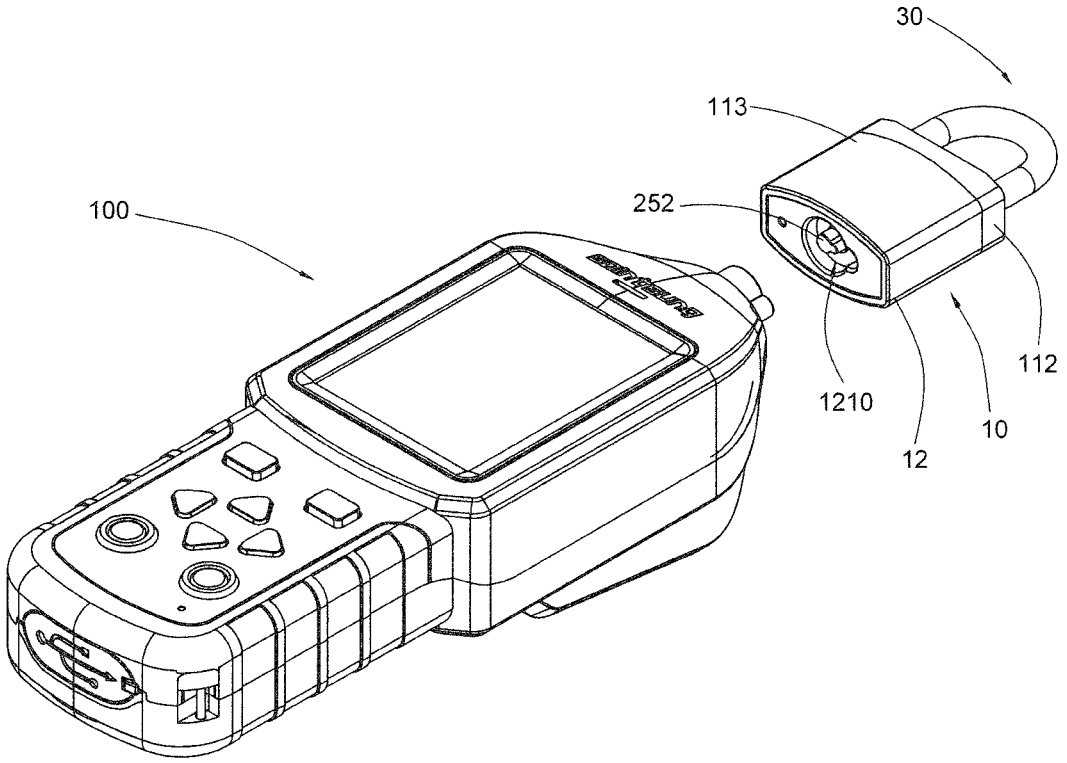
FIG. 18 is a side view of an automatic unlocking device for unlocking the combination lock according to the above preferred embodiment of the present invention.
Figure 19:
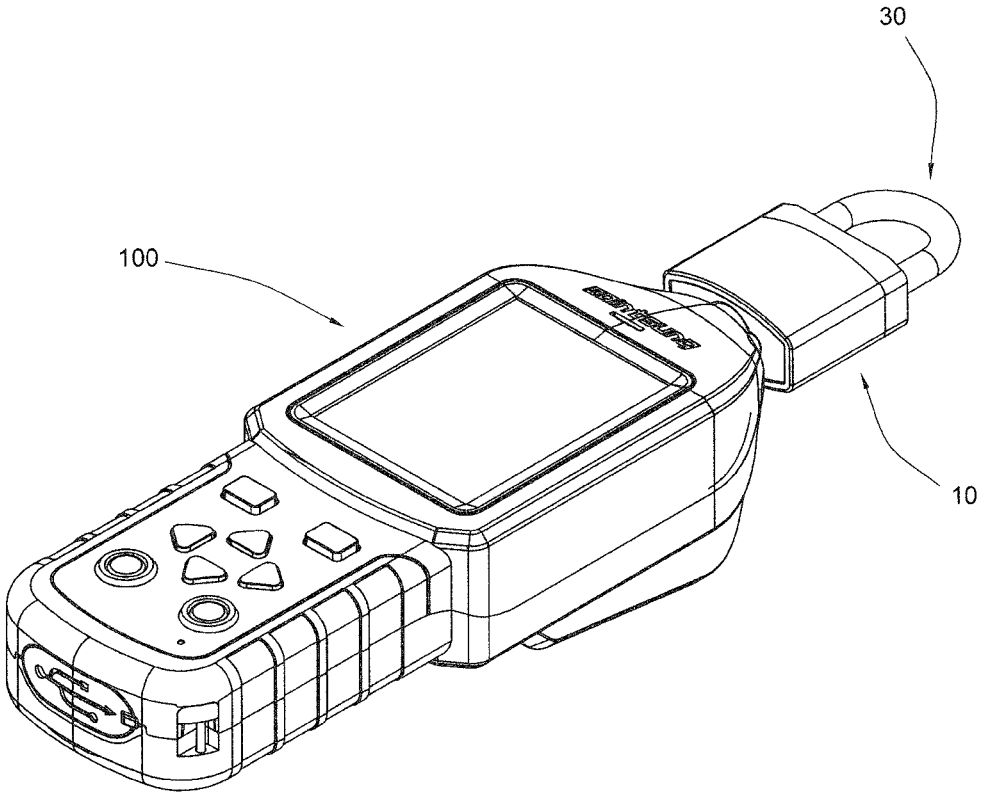
FIG. 19 is a side view of an automatic unlocking device for unlocking the combination lock according to the above preferred embodiment of the present invention, wherein the automatic is connected to the operating end of the driving portion of the driving shaft.

As shown in FIG. 13, FIG. 14 and FIG. 16, the lock member 20 further comprises a driving shaft 25, and the lower end 212 of the housing 21 has a shaft hole 2120, wherein the driving shaft 25 comprises a received portion 251 rotatably received within the second receiving chamber 210 and a driving portion 252 rotatably and downwardly extended from the received portion 251. The driving portion 252 passes through the shaft hole 2120 of the lower end 212, wherein the driving disc 231 is fixed with the received portion 251 of the driving shaft 25 and held within the second receiving chamber 210 by the lower end of the housing 21 such that a user is able to drive the driving portion 252 of the driving shaft 25 by rotating the driving portion 252 to rotate the driving disc 231 and align the driving opening 2310 of the driving disc 231 with the unlocking element 22 so as to allow the blocking rib 222 of the unlocking element 22 to fall into the driving opening 2310.

As shown in FIG. 10, FIG. 12, and FIG. 14 to FIG. 16, the disc unit 23 of the lock member 20 further comprises a plurality of driven discs 232 rotatably provided between the upper end 211 and the driving disc 231, wherein each driven disc 232 is rotatably coupled with the received portion 251 of the driving shaft 25. Each of the driven discs 232 has a notch 2320 adapted to align with the driving opening 2310, wherein the driving disc 231 is adapted for driving the driven discs 232 to rotate in a sequent manner to enable the notch 2320 to align with the driving opening 2310 so as to define an unlocking slot 230 for receiving the blocking rib 222 of the unlocking element 22 therein. In other words, the unlocking slot 230 allows the blocking rib 222 of the unlocking element 22 to fall into the unlocking slot 230 such that a user is able to rotate the driving disc 231 and the driven disc 232 by driving the driving shaft 25 to rotate to align the driving opening 2310 with the notch 2320 so as to define the unlocking slot 230 to enable the blocking rib 222 of the unlocking element 22 to fall into the unlocking slot 230. Preferably, the driven discs 232 are held within the second receiving chamber 210 by the driving shaft 25.

As shown in FIG. 16, the lock member 20 further comprises a pressed spring 26 provided between the upper end 211 and the driven disc 232 to hold the driven disc 232 and the driving disc 231 at a position. It is worth mentioning that the lock member 20 is constructed to include the driving and driven discs 231, 232 coaxailly coupled at the driving shaft 25.

It is worth mentioning that the driving disc 231 further comprises a first driving pin 2312, and the driven disc 232 comprises a driven body 2321 and a driven pin 2322, wherein the driving body 2311 has a first driving side 23113, and the driven body 2321 has a driven side 23211, wherein the first driving pin 2312 is perpendicularly provided on the driven side 23211, and the driven pin 2322 is perpendicularly provided on the driven side 23211. The first driving pin 2312 of the driving disc 231 is adapted to couple with the driven pin 2322 of the driven disc 232 such that when the driving disc 231 rotates, the first driving pin 2312 is able to meet the driven pin 2322 and push the driven pin 2322 and the driven disc 232 so as to align the notch 2320 with the driving opening 2310 to define the unlocking slot 230 for the unlocking element 22.

It is worth mentioning that the driving disc 231 and the driven disc 232 define a first distance of L1 therebetween, wherein the first driving pin 2312 of the driving disc 231 has a height of H1, and the driven pin 2322 of the driven disc 232 has a height of H2, wherein the first distance of L1 is less than the total length of H1 and H2 such that when the driving disc 231 rotates, the first driving pin 2312 is able to meet the driven pin 2322 and push the driven pin 2322 so as to rotate the driven disc 232.

Preferably, the disc unit 23 comprises a predetermined number of driven discs 232 respectively and orderly provided between the upper end 211 and the driving disc 231, wherein each of the driven discs 232 is rotatably coupled with the received portion 251 of the driving shaft 25, wherein each of the driven discs 232 has a notch 2320 adapted to align with the driving opening 2310, and the driving disc 231 is adapted for orderly driving the driven discs 232 to rotate to enable the notch 2320 of each of the driven discs 232 to align with the driving opening 2310 so as to define an unlocking slot 230 for receiving the blocking rib 222 of the unlocking element 22 therein. In other words, the unlocking slot 230 allows the blocking rib 222 of the unlocking element 22 to fall into the unlocking slot 230 such that a user is able to rotate the driving disc 231 and the driven disc 232 by driving the driving shaft 25 to rotate to align the notch 2320 of each of the plurality of driven discs 232 with the driving opening 2310 so as to define the unlocking slot 230 to enable the blocking rib 222 of the unlocking element 22 to fall into the unlocking slot 230, as shown in FIG. 9 to FIG. 16. Preferably, each of the driven discs 232 is held within the second receiving chamber 210 by the driving shaft 25.

It is worth mentioning that the driving disc 231 further comprises a first driving pin 2312, and each of the driven discs 232 comprises a driven body 2321, a driven pin 2322 and a second driving pin 2323, wherein the driving body 2311 has a first driving side 23113, and the driven body 2321 has a driven side 23211 and a second driving side 23212, wherein the first driving pin 2312 of the driving disc 231 is provided on the driven side 23211, the driven pin 2322 of the driven disc 232 is provided on the driven side 23211, the second driving pin 2323 of the driven disc 232 is provided on the second driving side 23212, wherein the first driving pin 2312 of the driving disc 231 is adapted to couple with the driven pin 2322 of the driven disc 232 next to the driving disc 231, wherein every two neighboring driven discs 232 define an upper driven disc 232 and a lower driven disc 232, and the second driving pin 2323 of the lower driven disc 232 is adapted to couple with the driven pin 2322 of the upper driven disc 232 such that when the driving disc 231 rotates, the first driving pin 2312 of the driving disc 231 is able to meet the driven pin 2322 of the driven disc 232 next to the driving disc 231, and the second driving pin 2323 of the lower driving disc 231 of every two neighboring driven discs 232 is able to meet the driven pin 2322 of the upper driven disc 232 of every two neighboring driven discs 232 and orderly drive each of the plurality of driven discs 232 to rotate so as to respectively align the notch 2320 of each of the driven discs 232 with the driving opening 2310 to define the unlocking slot 230 for the unlocking element 22, as shown in FIG. 10 and FIG. 12.

Preferably, the driven body 2321 has a driven side 23211 facing towards the driving disc 231 and a driving side 23213 facing towards the upper end 211.

It is worth mentioning that the driving disc 231 and the driven disc 232 next to the driving disc 231 define a first distance of L1 therebetween, wherein the first driving pin 2312 of the driving disc 231 has a height of H1, and the driven pin 2322 of the driven disc 232 next to the driving disc 231 has a height of H2, wherein the first distance of L1 is less than the total length of H1 and H2 such that when the driving disc 231 rotates, the first driving pin 2312 is able to meet the driven pin 2322 and push the driven pin 2322 so as to rotate the driven disc 232.

Similarly, the two neighboring driven discs 232 define a second distance of L2 therebetween, wherein the second driving pin 2323 of the lower driven disc 232 of the two neighboring driven discs 232 has a height of H3, and the driven pin 2322 of the upper driven disc 232 of the two neighboring driven discs 232 has a height of H2, wherein the second distance of L2 is less than the total length of H3 and H2 such that when the lower driving disc 232 rotates, the second driving pin 2323 of the lower driven disc 232 is able to meet the driven pin 2322 of the upper driven disc 232 and so as to rotate the upper driven disc 232.

As shown in FIG. 16, the lock member 20 further comprises a pressed spring 26, wherein the pressed spring 26 is provided between the upper end 211 and the disc unit 23 to so as to hold each of the driven discs 232 at a position.

Alternatively, the driven discs 232 are respectively and orderly provided between the upper end 211 and the driving disc 231, wherein each of the plurality of driven discs 232 is rotatably coupled with the received portion 251 of the driving shaft 25, wherein the pressed spring 26 is provided between the lower end 211 and the disc unit 23 to support each of the driven discs 232 at a position.

A method of unlocking a lock member 20, comprising the following steps.

(1) Rotate the driving shaft 25 in a first direction to drive the driving disc 231 to rotate in a first direction, wherein the driven discs 232 are consequently rotated by the driving disc 231 via the driving pins until the driven disc 232 at the farthest distance from the driving disc 231, i.e. the last driven disc, is rotate to locate the notch of the last driven disc 232 at the unlocked position.

(2) Rotate the driving shaft 25 in an opposed second direction to drive the driving disc 231 to rotate in a second direction, wherein the driven discs 232, except the last driven rotating disc, are consequently rotated by the driving disc 231 via the driving pins until the second last driven disc 232 is rotate to locate the notch of the second last driven disc 232 at the unlocked position.

(3) Repeat steps (1) and (2) until all the notches of the driven discs 232 are located at the unlocked position.

(4) Rotate the driving shaft 25 to rotate the driving disc 231 until the notch of the driving disc 231 is located at the unlocked position.

As shown in FIG. 8 to FIG. 12, the housing 21 of the lock member 20 further comprises a driving gear 214, and the upper end 211 of the housing 21 has a top side 2111, wherein the driving gear 214 is provided on the top side 2111 of the upper end 211 for driving the first locking element 40 to move in a reciprocating manner between a shackle locking state and a shackle releasing state.

As shown in FIG. 8 to FIG. 10, the first driven portion 42 of the first locking element 40 comprises a toothed end side 421 adapted to be engaged with the driving gear 214 such that when the lock member 20 rotates, the driving gear 214 is able to drive the first locking element 40 to move between a shackle locking state and a shackle releasing state.

Figure 4:
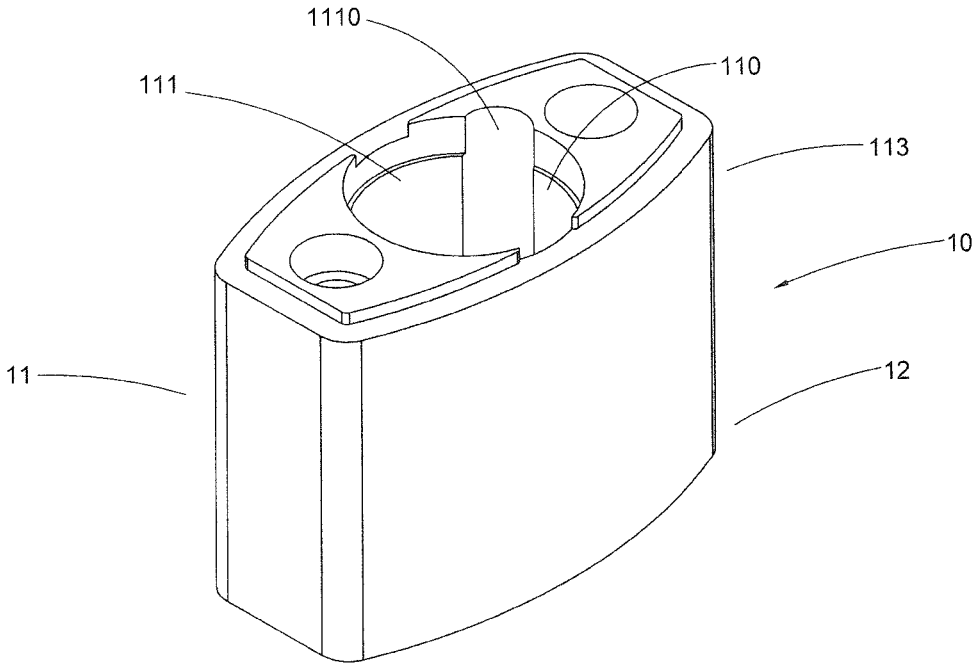
FIG. 4 is a side view of the lock body of the combination lock according to the above preferred embodiment of the present invention.
Figure 5:
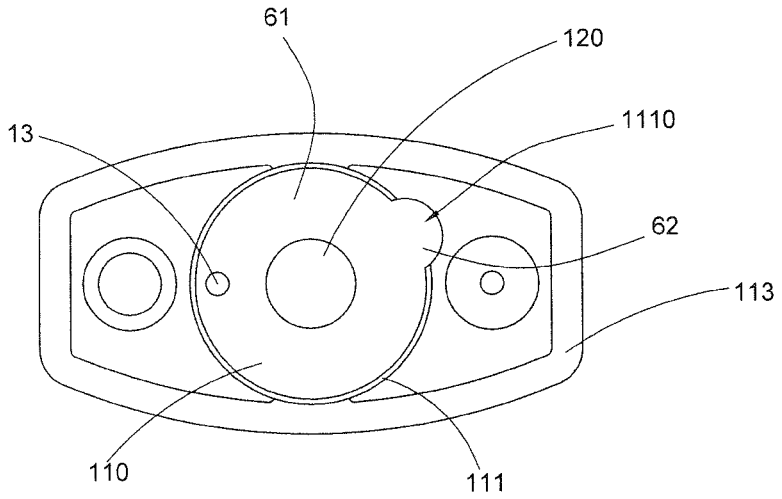
FIG. 5 is a top view of the lock body of the combination lock according to the above preferred embodiment of the present invention.
Figure 6:
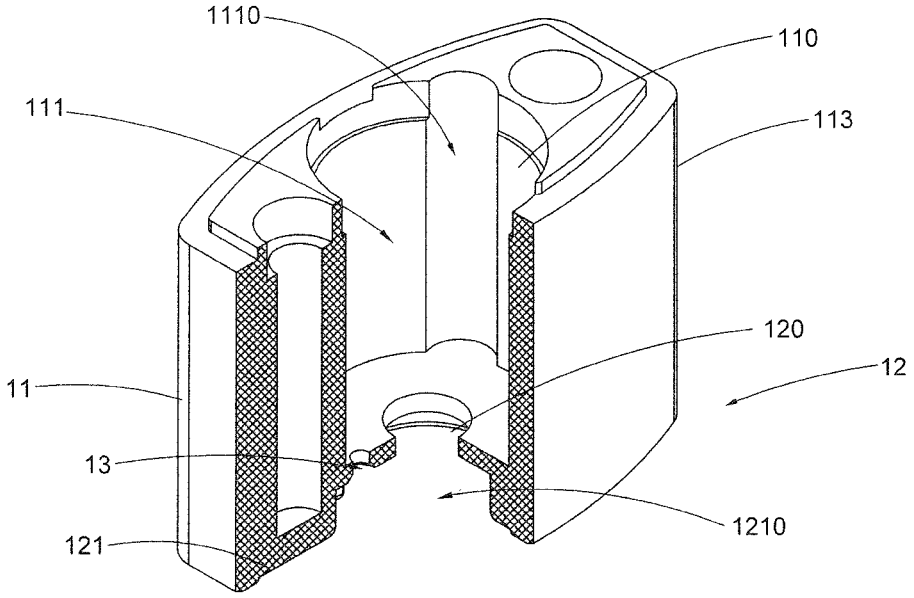
FIG. 6 is a partially sectional view of the lock body of the combination lock according to the above preferred embodiment of the present invention.

As shown in FIG. 4 to FIG. 6, the upper portion 11 has an inner side 111 and a resetting cavity 1110 provided in the inner side 111 and communicatedly connected with the first receiving chamber 110, wherein the resetting cavity 1110 is shaped and sized to be adapted to receive the unlocking element 22 therein. The unlocking element 22 is directed to the resetting cavity 1110 of the lock body 10 such that when the notch 2320 of each of the driven discs 232 is aligned with the driving opening 2310 to define the unlocking slot 230 for the unlocking element 22, the unlocking element 22 is forced to leave from the resetting cavity 1110 by the elastic element 24 and fall into the unlocking slot 230. When the unlocking element 22 is pushed by the driving disc 231 to separate from the driving opening 2310, the unlocking element 22 is adapted to reset into the resetting cavity 1110 and is held at a position by the inner side 111 of the upper portion 11 of lock body 10.

Figure 2:
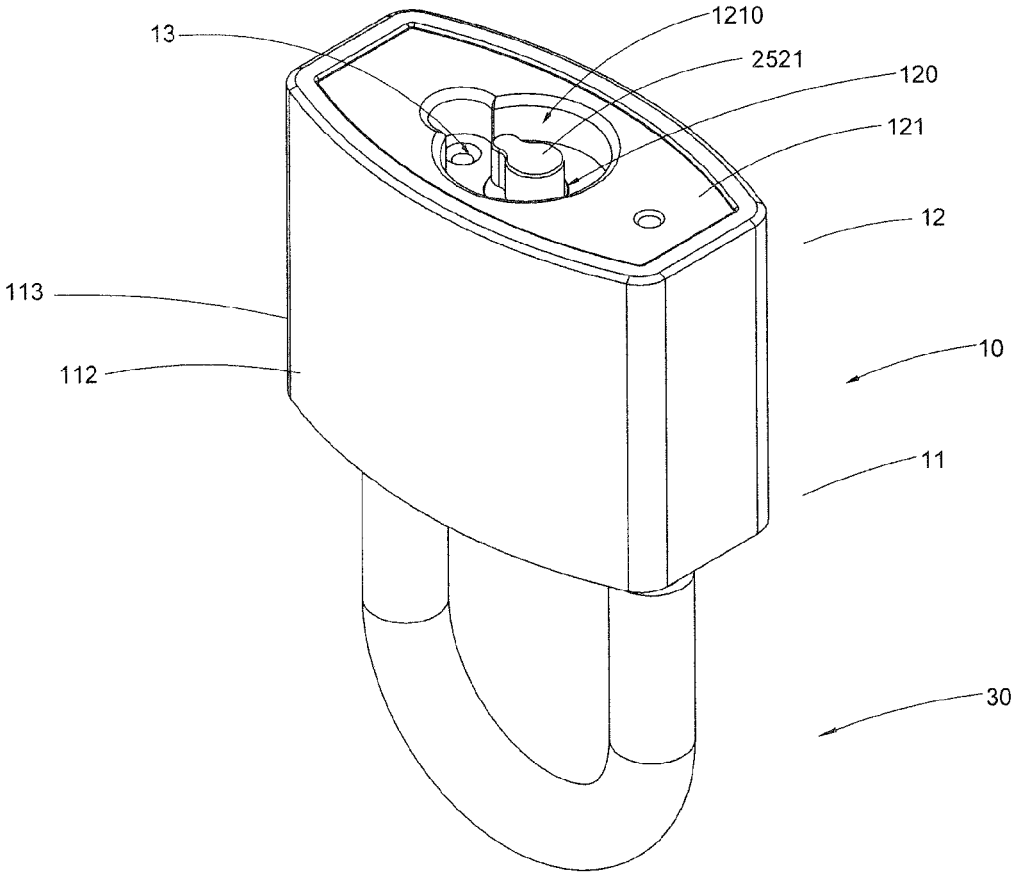
FIG. 2 is another perspective view of the combination lock according to the above preferred embodiment of the present invention.

As shown in FIG. 2 and FIG. 6, the lower portion 12 has an operating inlet 120 direct to the driving portion 252 of the driving shaft 25 to enable a user to drive the driving portion 252 of the driving shaft 25 to rotate the driving shaft 25 through the operating inlet 120.

As shown in FIG. 12 to FIG. 15, the driving portion 252 of the driving shaft 25 comprises an operating end 2521, wherein the operating end 2521 is adapted to pass through the operating inlet 120 to protrude from the first receiving chamber 110 so as to enable the user to drive the operating end 2521 of the driving portion 252 to rotate the driving shaft 25.

Figure 7:
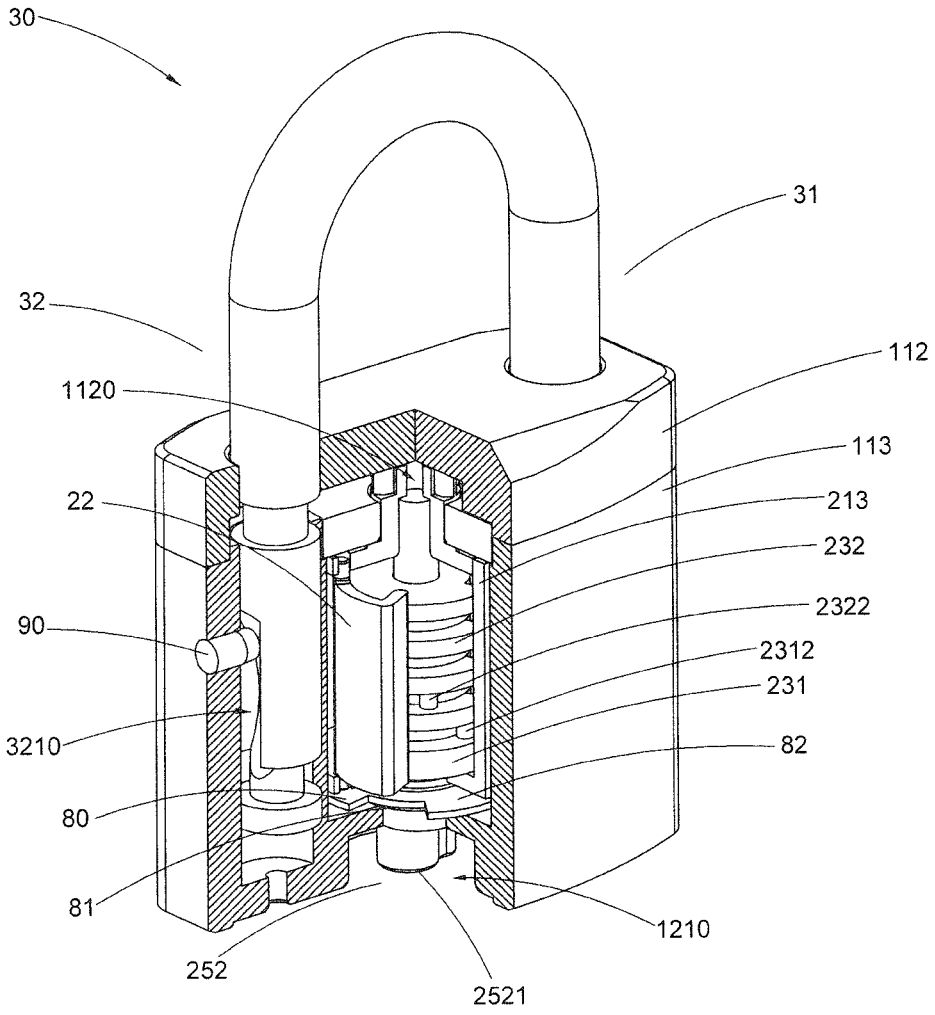
FIG. 7 is another side view of the lock body of the combination lock according to the above preferred embodiment of the present invention.

As shown in FIG. 2 and FIG. 7, the lower portion 12 of the lock body 10 comprises a bottom side 121, wherein the bottom side 121 has an operating chamber 1210 provided in the bottom side 121, wherein the operating inlet 120 is communicatedly provided within the operating chamber 1210, wherein the operating end 2521 is adapted to protrude from the first receiving chamber 110 through the operating inlet 120 and is hidden inside the operating chamber 1210.

Figure 3A:
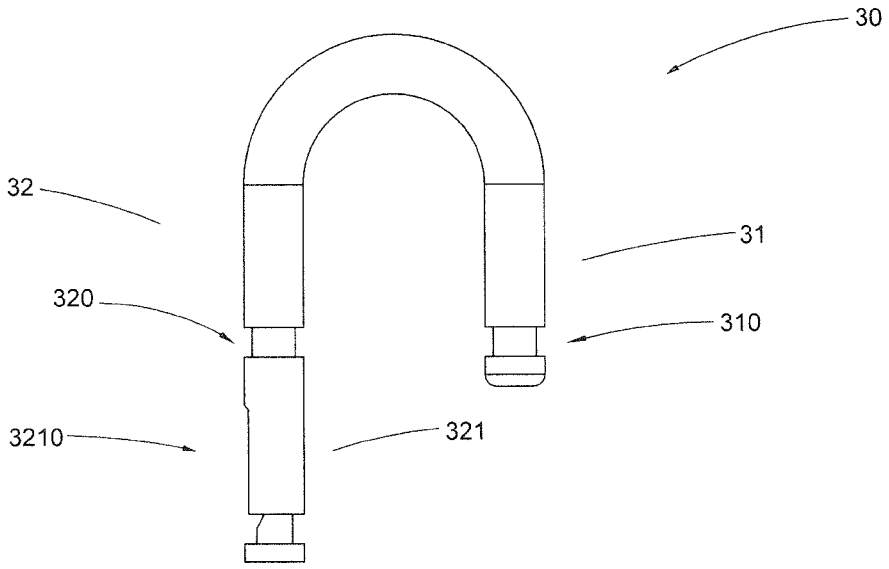
FIG. 3A is a side view of the shackle of the combination lock according to the above preferred embodiment of the present invention.
Figure 3B:
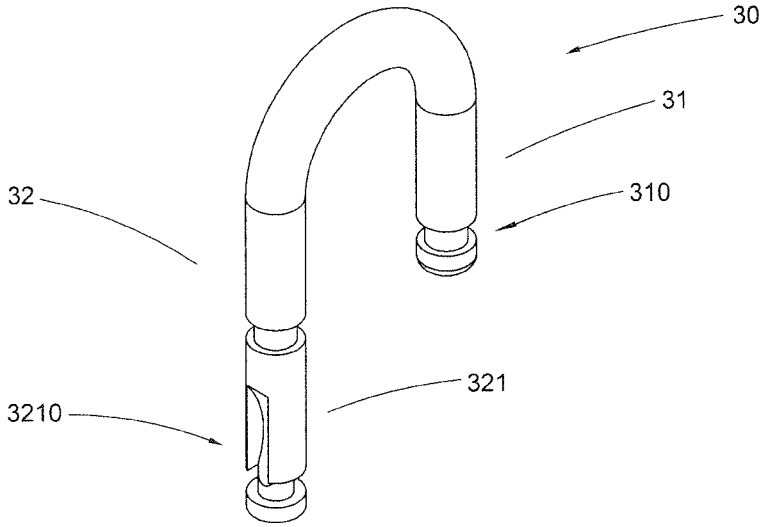
FIG. 3B is a perspective view of the shackle of the combination lock according to the above preferred embodiment of the present invention.

As shown in FIG. 3A and FIG. 3B, the first leg 31 of the shackle 30 has a first locking notch 310, and the second leg 32 of the shackle 30 has a second locking notch 320 such that when the shackle 30 is at the shackle locking state, the first locking portion 41 of the first locking element 40 is adapted to be driven to engaged with the first leg 31, and the second locking portion 51 of the second locking element 50 is adapted to be driven to engaged with the second leg 32. Preferably, the second leg 32 of the shackle 30 comprises a leg body 321 and an elongated portion 322 extended from the leg body 321, wherein the leg body 321 defines the second locking notch 320, and the elongated portion 322 defines a positioning slot 3210, wherein the positioning slot 3210 has an arc-shaped sectional view, wherein the combination lock further comprises a positioning pin 90, wherein when the second leg 32 of the shackle 30 is provided in the lock body 10, the positioning pin 90 is extended from the lock body 10 to the elongated portion 322 of the second leg 32 and provided in the positioning slot 3210 such that the second leg 32 of the shackle 30 is adapted to be held in the lock body 10 and move up and down.

As shown in FIG. 8 to FIG. 10, the combination lock of the present invention further comprises a second locking element 50 movably coupled with the lock member 20, wherein the second locking element 50 is adapted to be driven by the lock member 20 to move in a reciprocating manner between the shackle locking state and the shackle releasing state. When the shackle 30 is at the shackle locking state, the second locking element 50 holds the second leg 32 within the lock body 10. When the shackle 30 is at the shackle unlocking state, the second locking element 50 is driven to leave from the second leg 32 of the shack so as to enable the second leg 32 to separate from the lock body 10.

Further, the second locking element 50 comprises a second locking portion 51 adapted to be engaged with the second leg 32 of the shackle 30 and a second driven portion 52 extended from the second locking portion 51 to the lock member 20 and adapted to be driven by the lock member 20 to move the second locking element 50 in a reciprocating manner so as to hold the second leg 32 at the shackle unlocking state, and leave from the second leg 32 at the shackle unlocking state.

It is worth mentioning that the second driven portion 52 of the second locking element 50 is engaged with the driving gear 214 and driven by the driving gear 214 to move in a reciprocating manner between the shackle locking state and the shackle releasing state.

As shown in FIG. 8 to FIG. 10, the second driven portion 52 of the second locking element 50 comprises a toothed end side 521 engaged with the driving gear 214 such that when the lock member 20 rotates, the driving gear 214 is able to drive the second locking element 50 to move between the shackle locking state and the shackle releasing state.

In other words, the first and second locking elements 40, 50 are concurrently moved via the rotational movement of the driving gear 214 and are concurrently moved between the shackle locking state and the shackle releasing state.

As shown in FIG. 7, the upper portion 11 comprises a cover body 112 and a chamber body 113 extended from the cover body 112, wherein the cover body 112 and the chamber body 113 define a locking chamber 1120 therebetween, wherein the locking chamber 1120 is adapted for receiving the first locking element 40 and the second locking element 50 therein, and the cover body 112 is arranged for keeping the first locking element 40 and the second locking element 50 being respectively engaged with the driving gear 214.

Figure 11B:
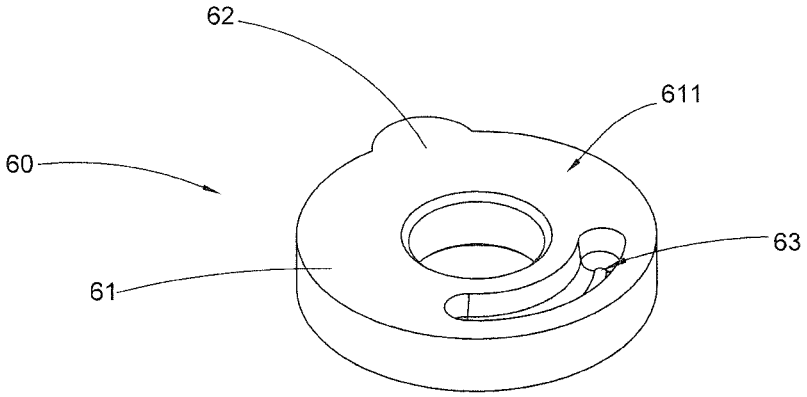
FIG. 11B is a perspective view of the stopping panel of the combination lock according to the above preferred embodiment of the present invention.

As shown in FIG. 11B, the combination lock of the present invention further comprises a stopping panel 60 provided in the lock body 10 and a stopping pin 70, in FIG. 11A, provided on the top side 2111 of the upper end 211 of the housing 21, The stopping panel 60 comprises a stopping body 61 received in the first receiving chamber 110 and coupled with the upper end 211 of the housing 21 and a stopping protrusion 62 outwardly extended from the stopping body 61, wherein the stopping protrusion 62 is received in the resetting cavity 1110. The stopping body 61 has a bottom side 611 and an arc-shaped slot 63 provided in the bottom side 611 of the stopping body 61, and the stopping pin 70 is adapted to be received in the arc-shaped slot and slide along the arc-shaped slot 63 so as to limit the lock member to rotate in a predetermined angle range.

It is worth mentioning that when the stopping body 61 is received in the first receiving chamber 110 and the stopping protrusion 62 is received in the resetting cavity 1110, wherein the stopping protrusion 62 is adapted to prevent the stopping body 61 rotating in the first receiving chamber 110.

Figure 15A:
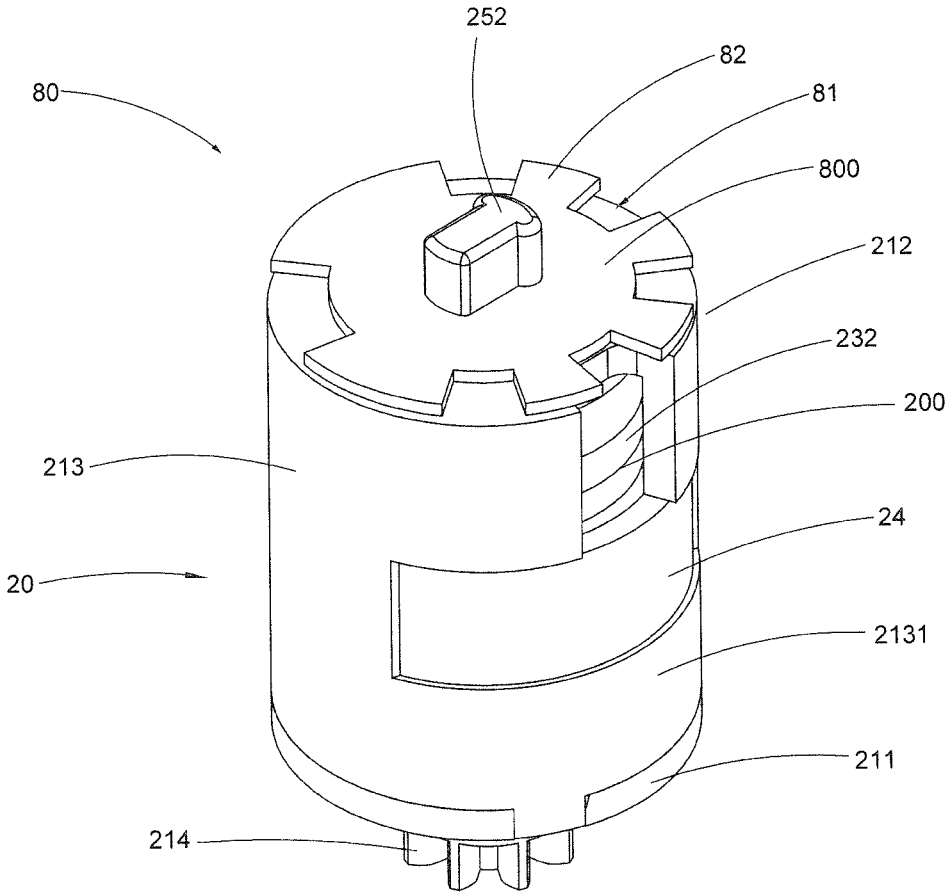
FIG. 15A is a perspective view of the combination unlocking device for a lock according to the above preferred embodiment of the present invention, illustrating the lock member has a coding wheel.
Figure 15B:
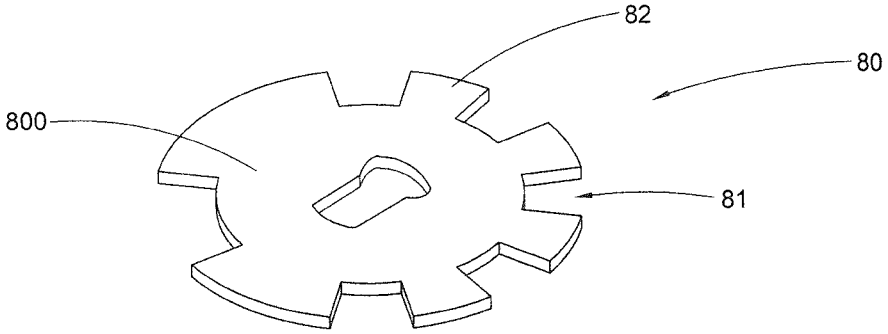
FIG. 15B is a perspective view of the coding wheel of the combination lock according to the above preferred embodiment of the present invention.

As shown in FIG. 15A and FIG. 15B, the combination lock of the present invention further comprises a coding wheel 80 provided between the lower end 212 of the housing 21 and the lower portion 12 of the lock body 10, wherein the coding wheel 80 is rotatably coupled with the driving portion 252 of the driving shaft 25 and is driven by the driving portion 252 of the driving shaft 25 to rotate. The coding wheel 80 has a reading side 800 facing the lower portion 12 of the lock body 10, wherein the lock body 10 has a laser hole 13 through the lower portion 12 of the lock body 10, and a laser beam is able to reach on the reading side 800 of the coding wheel 80 through the laser hole 13.

It is worth mentioning that the coding wheel 80 has a plurality of coding openings 81 and a plurality of coding portions 82, wherein the coding portions 82 is separated from each other by the coding openings 81 so as to define a coding pattern representing corresponding information such that when the coding wheel 80 rotates, a user is able to scan the reading side 800 of the coding wheel 80 by a laser scanner and obtain the corresponding information coded by the coding wheel 80 by decoding.

In other words, the rotary motion of the driving shaft 25 for unlocking the combination lock is coded by the coding pattern defined by the plurality of coding openings 81 and the plurality of coding portions 82 of the coding wheel 80, and the user is able to obtain the coding pattern by scanning the reading side 800 of the coding wheel 80 to rotate the driving shaft 25 to align the notch 2320 of each of the driven discs 232 by an automatic unlocking device 1 and the driving opening 2310 of the driving disc 231 so as to rotate the lock member 20 and unlock the combination lock.

It is worth mentioning the coding wheel 80 is hidden inside the lock body 10 and the user can't see the reading side 800 of the coding wheel 80. On the other hand, even though the user is able to see the coding pattern, he still don't know what the rotary motion of the driving shaft 25 for unlocking the combination lock is and how to rotate the driving portion 252 of the driving shaft 25 to unlock the combination lock. Preferably, the automatic unlocking device 100 comprises a laser scanner 101, a controller 102 electrically connected with the laser scanner 101, and a motor 103 electrically connected with the controller 102 and arranged for driving the driving portion 252 of the driving shaft 25 to rotate, wherein when the coding wheel 80 is driven to rotate, a user is able to scan the reading side 800 of the coding wheel 80 by a laser scanner 101 to obtain the coding pattern of the coding wheel 80, the coding pattern is transmitted to the controller to control the motor to rotate the driving shaft 25 depending on the coding pattern of the coding wheel 80 so as to unlock the combination lock in an automatic and keyless manner.

As shown in FIG. 13, the lock member 20 further has a laser reducing channel extended from the lower end 212 of the housing 21 of the lock member 20 to the side wall 213 of the housing 21, wherein the laser reducing channel is directed to the laser hole 13 in FIG. 2 and adapted to prolong the distance that a laser beam freely travels in the receiving chamber 110 so as to reduce the intensity of the corresponding inflected laser beam.

In addition, all the rotating discs 231, 232 are driven from the driving shaft 25. Therefore, the rotating axle can be driven to rotate through the automatic unlocking device 1 which provides a reversible rotatable power to drive the driving shaft 25 in a clockwise direction and a counter clockwise direction. As a result, the present invention provides an efficient solution to solve the existing problem of the combination lock which cannot be operated automatically. It is worth mentioning that the combination lock of the present invention does not contain any key slot or any through slot extended into the second receiving chamber 210. Therefore, the driving disc 321 and the driven discs 322 are concealed in the second receiving chamber 210 to prevent any external tool inserting into second receiving chamber 210.

Figure 20:
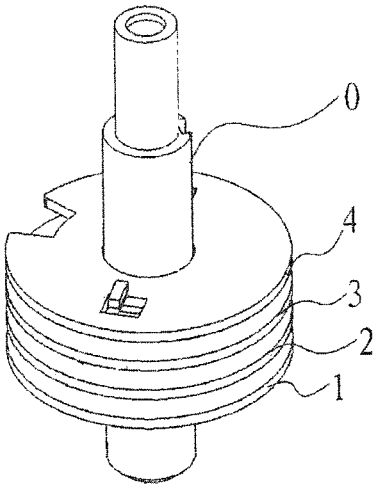
FIG. 20 is a perspective view of lock core of a combination lock according to a second preferred embodiment of the present invention.
Figure 21:
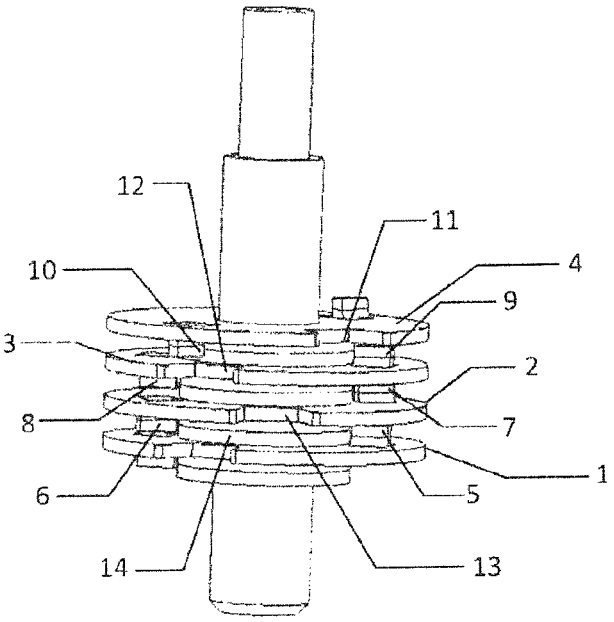
FIG. 21 is a side view of the lock core according to the above second preferred embodiment of the present invention.

Referring to FIGS. 20 and 21 of the drawings, the lock member 20 of the combination lock can be described that the lock member 20 forms the lock core of the combination lock. The lock core comprises a rotating axle 0 (i.e. the driving shaft), a plurality of rotating discs 1, 2, 3, 4 (i.e. including the driving disc and the driven discs). The number of rotating discs can be altered and should not be limited. The number of rotating discs can be configured according to the need of the combination lock. According to the preferred embodiment, four rotating discs 1, 2, 3, 4, i.e. first to fourth rotating discs, are illustrated.

The rotating axle 0 is a driving mechanism of the lock core.

The rotating discs 1, 2, 3, 4 are the key components of the lock core. Preferably, the rotating discs 1, 2, 3, 4 are identical and are coaxially and rotatably coupled at the rotating axle 0 at a position that the rotating discs 1, 2, 3, 4 are overlapped with each other.

In addition, a plurality of locking grooves 14, 13, 12, 11 are formed at peripheral portions of the rotating discs 1, 2, 3, 4 and are extended at a radial direction thereof. Accordingly, when the rotating discs 1, 2, 3, 4 are rotated to align all the locking grooves 14, 13, 12, 11, the lock core is in an unlocked position to unlock the combination lock.

In order to achieve the automatic locking/unlocking operation of the combination lock, one of the rotating discs 1, 2, 3, 4 can be selected as a driving rotating disc 1 which is located at the outermost position among the rotating discs at the rotating axle 0. For example, the first rotating disc 1 can be selected as the driving rotating disc. Or the fourth rotating disc 4 can also be selected as the driving rotating disc. The rest of the rotating discs will be the driven rotating discs. Accordingly, the driving rotating disc 1 is driven to rotate when the rotating axle 0 is rotated. The driving rotating disc 1 will drive the driven rotating discs 2, 3, 4 to rotate.

In order to achieve the movements of the rotating discs and to configure the lock code thereof, the lock core further comprises a plurality of disc movers 5, 6, 7, 8, 9, alternating with the rotating discs 1, 2, 3, 4. In particular, the first disc mover 5 is located between the disc surfaces of the first and second rotating discs 1, 2, wherein the first disc mover 5 is provided at the first rotating disc 1 at a predetermined radial location. The second disc mover 6 is provided at the second rotating disc 2 at a predetermined radial location and is radially extended at the second rotating disc 2 to interact with the first disc mover 5. Accordingly, a distance between the first and second rotating discs 1, 2 is preset to enable the first and second disc movers 5, 6 to be interacted with each other. In other words, when the first rotating disc 1 is rotated to drive the first disc mover 5 around the rotating axle 0, the first disc mover 5 is moved to hit and push at the second disc mover 6 so as to drive the second rotating disc 2 to rotate.

Likewise, the third disc mover 7 is located between the disc surfaces of the second and third rotating discs 2, 3, wherein the third disc mover 7 is provided at the second rotating disc 2 at a predetermined radial location. The fourth disc mover 8 is provided at the third rotating disc 3 at a predetermined radial location and is radially extended at the third rotating disc 3 to interact with the third disc mover 7. When the second rotating disc 2 is rotated to drive the third disc mover 7 around the rotating axle 0, the third disc mover 7 is moved to hit and push at the fourth disc mover 8 so as to drive the third rotating disc 3 to rotate.

The fifth disc mover 9 is located between the disc surfaces of the third and fourth rotating discs 3, 4, wherein the fifth disc mover 9 is provided at the third rotating disc 3 at a predetermined radial location. The sixth disc mover 10 is provided at the fourth rotating disc 4 at a predetermined radial location and is radially extended at the fourth rotating disc 4 to interact with the firth disc mover 9. When the third rotating disc 3 is rotated to drive the fifth disc mover 9 around the rotating axle 0, the fifth disc mover 9 is moved to hit and push at the sixth disc mover 10 so as to drive the fourth rotating disc 4 to rotate.

It is worth mentioning that the second disc mover 6 and the third disc mover 7 are provided at two opposed disc surfaces of the second rotating disc 2. The fourth disc mover 8 and the fifth disc mover 9 are provided at two opposed disc surfaces of the third rotating disc 3.

Accordingly, the radial locations of the two corresponding disc movers between two disc surfaces of the corresponding rotating disc are symmetrical. In other words, the radial locations of the first and second disc movers 5, 6 between the first and second rotating discs 1, 2 are symmetrical. The radial locations of the third and fourth disc movers 7, 8 between the second and third rotating discs 2, 3 are symmetrical. The radial locations of the fifth and sixth disc movers 9, 10 between the third and fourth rotating discs 3, 4 are symmetrical. Furthermore, the arc angle a between each disc mover and the corresponding locking groove with respect to the center of the rotating disc must be larger than 0 degree and smaller than 360 degrees) (360°<a<0°.

It is worth mentioning that the rotational movement of each of the rotating discs is actuated via the interaction among the disc movers. The lock code of the lock core will be formed by an arc-distance between the two corresponding disc movers.

For example, four identical rotating discs 1, 2, 3, 4 are provided to incorporate with the first to sixth disc movers 5, 6, 7, 8, 9, 10, wherein the disc gaps between every two rotating discs are even.

The lock code P for the above mentioned structural configuration of the lock core is shown as follows:

$$p = \left(\frac{2\Omega R}{D}\right)^N$$

wherein R represents a radius of each rotating disc, D represents a thickness of each disc mover, and N represents the number of rotating disc.

The following will explain the operational principle of the lock core of the present invention.

The lock core is constructed to include the rotating discs coaxailly and rotatably coupled at the rotating axle, wherein the disc movers are provided between every two of the rotating discs and are interacted with each other in order to dive the rotating disc to rotate in sequence manner. The lock code of the lock core is formed by an arc distance between two corresponding disc movers.

As shown in FIG. 21, when the rotating axle 0 is driven to rotate in a clockwise direction, the first rotating disc 1, as driving rotating disc, will be driven to rotate correspondingly. At the same time, the first disc mover 5 at the first rotating disc 1 is driven to move, wherein when the first disc mover 5 contacts the second disc mover 6 at the second rotating disc 2, the second disc mover 6 is pushed by the first disc mover 5 so as to drive the second rotating disc 2 in a clockwise direction consequently.

When the second rotating disc 2 is rotated in a clockwise direction, the third disc mover 7 at the second rotating disc 2 is driven to move, wherein when the third disc mover 7 contacts the fourth disc mover 8 at the third rotating disc 3, the fourth disc mover 8 is pushed by the third disc mover 7 so as to drive the third rotating disc 3 in a clockwise direction consequently.

When the third rotating disc 3 is rotated in a clockwise direction, the fifth disc mover 9 at the third rotating disc 3 is driven to move, wherein when the fifth disc mover 9 contacts the sixth disc mover 10 at the fourth rotating disc 4, the sixth disc mover 10 is pushed by the fifth disc mover 9 so as to drive the fourth rotating disc 4 in a clockwise direction consequently. As a result, the fourth rotating disc 4 is in a clockwise direction until the locking groove 11 at the fourth rotating disc 4 is located in an unlocked position.

Then, when the first rotating disc 1 is started to rotate in a counter clockwise direction via the rotational movement of the rotating axle 0, the first disc mover 5 is driven to move in order to contact and push at the second disc mover 6 so as to rotate the second rotating disc 2 in a counter clockwise direction. Likewise, the third rotating disc 3 is driven to rotate in a counter clockwise direction via the third and fourth disc movers 7, 8 until the locking groove 12 at the third rotating disc 3 is located in the unlocked position. It is worth mentioning that since the rotating angle of the third rotating disc 3 is smaller than 360°, the fifth disc mover 9 at the third rotating disc 3 will not contact the sixth disc mover 10. Therefore, the fourth rotating disc 4 will not be rotated and will be remained idle so as to retain the locking groove 11 at the fourth rotating disc 4 in the unlocked position.

Then, when the first rotating disc 1 is started to rotate in a clockwise direction again via the rotational movement of the rotating axle 0, the first disc mover 5 will contact the second disc mover 6 at the second rotating disc 2 to drive the second rotating disc 2 in a clockwise direction consequently until the locking groove 13 at the second rotating disc 2 is located at the unlocked position. It is worth mentioning that the third and fourth rotating discs 3, 4 will not be rotated and will be remained idle so as to retain the locking grooves 12, 11 at the third and fourth rotating discs 3, 4 in the unlocked position.

At this time, the first rotating disc 1 is started to rotate again in a counter clockwise direction via the rotational movement of the rotating axle 0 until the locking groove 14 at the first rotating disc 1 is located at the unlocked position. The second, third and fourth rotating discs 2, 3, 4 will not be rotated and will be remained idle so as to retain the locking grooves 13, 12, 11 at the second, third and fourth rotating discs 2, 3, 4 in the unlocked position. In other words, all the locking grooves, 14, 13, 12, 11 are located at the unlocked position. Therefore, all the rotating discs 1, 2, 3, 4 are consequently rotated until the locking grooves 14, 13, 12, 11 thereof are aligned with each other, i.e. an unlocked position of the lock core.

According to the preferred embodiment, the unlocking process of the lock core can be automatically operated through the sequent clockwise and counter clockwise rotational movements of the rotating axle 0.

Figure 22:
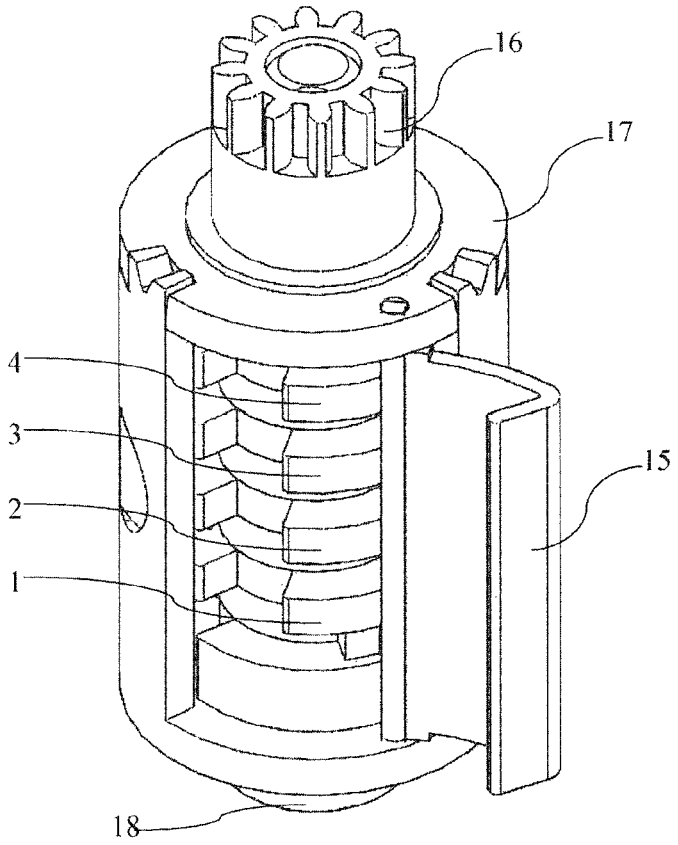
FIG. 22 is a perspective view of the combination lock with the lock core according to the above second preferred embodiment of the present invention.

FIG. 22 illustrates the lock core is coupled at a lock assembly which comprises a tubular lock body 17 having a cavity, a lock gear 16 coupled at the lock body 17, and a locking latch 15 movably coupled at the lock body 17, wherein the lock core is disposed in the cavity. The first rotating disc 1 is coaxially affixed at the rotating axle 0 in a non-rotatable manner, wherein the second to fourth rotating disc 2, 3, 4 are coaxially coupled at the rotating axle 0 in a rotatably movable manner. Each of the rotating discs has two disc movers provided at two opposed disc surfaces of rotating discs respectively, wherein the two disc movers are located symmetrically. The locking grooves at the rotating discs are identical.

Figure 23:
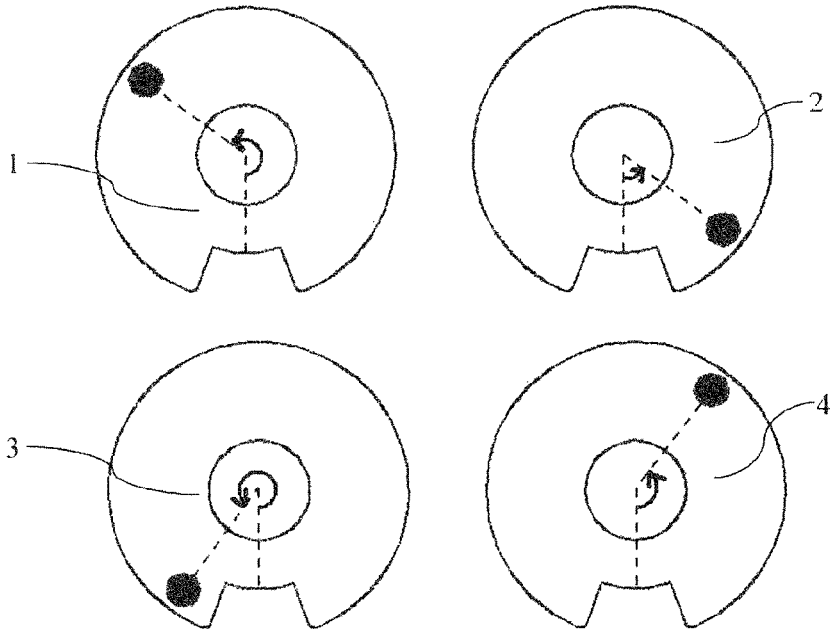
FIG. 23 is a top view of the rotating discs of the lock core according to the above second preferred embodiment of the present invention, illustrating the corresponding locations of paddle and locking slot of each of the rotating discs.

As shown in FIG. 23, the arc angles between the disc movers and the locking grooves with respect to the centers of the rotating discs 1, 2, 3, 4 are 240°, 45°, 330°, and 140° respectively.

At the locked position, the locking grooves of the four rotating discs are not aligned with each other. In other words, the unlocked position of the lock core is defined when the locking grooves of the four rotating discs are aligned with each other to form a straight locking channel. At the locked position, the locking latch 15 cannot be engaged with the locking grooves. Therefore, the lock core cannot drive the lock body to rotate. The lock gear 16 cannot be driven to rotate as well.

In order to unlock the lock assembly, a corresponding key must be inserted into a key slot 18 of the tubular lock body 17. The key can be an automate key element driven to be rotated automatically. The rotating axle 0 can then be rotated in a clockwise direction via the rotational movement of the key. It is preferred that the rotating axle 0 is rotated in three revolutions, i.e. 360°×3=1080°. After three revolutions of the rotating axle 0, the disc movers between the first and second rotating discs, between the second and third rotating discs, and between the third and fourth rotating discs, will be contacted with each other. This is the initial position of the lock core. At this initial position, the rotating axle 0 can then rotate in a clockwise direction to move the locking groove at the fourth rotating disc in an unlock position with respect to the arc angle of the fourth rotating disc 4. Accordingly, the arc angle of the fourth rotating disc 4 is set at 240°. Therefore, when the fourth rotating disc 4 is rotated at 120° from the initial position, the locking groove 11 is located in the unlocked position.

Then, the key can be controlled to automatically rotate in a counter clockwise direction. It is preferred that the rotating axle 0 is driven to rotate in two revolutions, i.e. 360°×2=720°, in a counter clockwise direction. The first disc mover 5 at the first rotating disc 1 is moved in a counter clockwise direction to hit and push at the opposed side of the second disc mover 6 at the second rotating disc 2 so as to drive the second rotating disc 2 to rotate in a counter clockwise direction. The third disc mover 7 at the second rotating disc 2 is moved in a counter clockwise direction to hit and push at the opposed side of the fourth disc mover 8 at the third rotating disc 3 so as to drive the third rotating disc 3 to rotate in a counter clockwise direction. Since the third rotating disc 3 is rotated less than 360°, the fifth disc mover 9 at the third rotating disc 3 will not contact with the sixth disc mover 10 at the fourth rotating disc 4. As a result, the first, second, and third rotating discs 1, 2, 3 are driven to rotate consequently in a counter clockwise direction, wherein the fourth rotating disc 4 will not be rotated and will be remained idle to retain the locking groove 11 at the fourth rotating disc 4 in the unlocked position. Accordingly, when the third rotating disc 3 is rotated at 165°, the locking groove 12 is located in the unlocked position.

The key can then be controlled to automatically rotate in a clockwise direction again. When the rotating axle 0 is rotated in 360°, the first disc mover 5 at the first rotating disc 1 is moved in a clockwise direction to hit and push at the second disc mover 6 at the second rotating disc 2 so as to drive the second rotating disc 2 to rotate in a clockwise direction. Since the second rotating disc 2 is rotated less than 360°, the third disc mover 7 at the second rotating disc 2 will not contact with the fourth disc mover 8 at the third rotating disc 4. As a result, the first and second rotating discs 1, 2 are driven to rotate consequently in a clockwise direction, wherein the third and fourth rotating discs 3, 4 will not be rotated and will be remained idle to retain the locking grooves 12, 11 at the third and fourth rotating disc 4 in the unlocked position. Accordingly, when the second rotating disc 2 is rotated at 75°, the locking groove 13 is located in the unlocked position.

The key can then be controlled to automatically rotate in a counter clockwise direction again. Since the first rotating disc 1 is rotated less than 360°, the first disc mover 5 at the first rotating disc 1 will not contact with the second disc mover 6 at the second rotating disc 4. As a result, only the first rotating disc 1 is driven to rotate in a counter clockwise direction, wherein the second, third and fourth rotating discs 2, 3, 4 will not be rotated and will be remained idle to retain the locking grooves 13, 12, 11 at the second, third and fourth rotating disc 4 in the unlocked position. Accordingly, when the first rotating disc 1 is rotated at 170°, the locking groove 14 is located in the unlocked position. In this position, all the locking grooves 14, 13, 12, 11 are aligned with each other and are located in the unlocked positions.

When the locking grooves 14, 13, 12, 11 are located in the unlocked positions to form the straight locking channel, the locking latch 15 can be engaged with the straight locking channel. Therefore, the tubular lock body 17 can be driven to rotate by the lock core in order to drive the lock gear 16 to rotate. In other words, a latch assembly can be actuated via the lock gear 16.

According to the preferred embodiment, the lock code of the lock core is set as 120°, 165°, 75°, 170° combined with a rotatable direction sequence in order to actuate the latch assembly. The lock code can be determined via the arc angle of each of the rotating discs, wherein the lock code configuration can be varied and should not be limited in the present invention.

The lock code can be set in different configuration by changing the positions of the second, third and fourth rotating discs such that the rotating angles of the rotating discs will be altered in order to change the rotatable direction sequence to align all the locking grooves with each other. Or, the arc angle of each rotating disc can be altered in order to change the rotating angle of each rotating disc to align all the locking grooves with each other.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A combination lock, comprising:

a lock body;

a shackle movably coupled at said lock body, wherein said shackle comprises a first leg and a second leg;

a lock member received in said lock body, which comprises;

a housing defining a second chamber, an upper end, and a lower end;

an unlocking element pivotally provided between said upper end and said lower end; and a disc unit rotatably provided within said second receiving chamber, wherein said disc unit comprises a driving disc, wherein said driving disc has at least one driving opening and enables said unlocking element to fit into said driving opening such that when said driving opening is aligned with said unlocking element, said unlocking element is engaged with said driving opening of said driving disc to enable said driving disc to drive said unlocking element and said housing of said lock member to rotate;

a first locking element movably coupled with said lock member and adapted to be driven by said lock member to move in a reciprocating manner between a shackle locking state and a shackle releasing state, wherein when said shackle is at said shackle locking state, said first locking element is engaged with said shackle, when said shackle is at said shackle unlocking state, said first locking element is driven to disengaged from said shackle; and an automatic unlocking device, wherein said automatic unlocking device comprises a laser scanner, a controller electrically connected with said laser scanner and a motor electrically connected with said controller for driving said disc unit to rotate so as to unlock said shackle in an automatic and keyless manner, wherein said first locking element comprises a first locking portion adapted to be engaged with said first leg of said shackle and a first driven portion extended from said first locking portion to said lock member and adapted to be driven by said lock member to move said first locking element in a reciprocating manner so as to hold said first leg at a position at said shackle unlocking state, and detach from said first leg at said shackle unlocking state, wherein when said lock member rotates, said first driven portion is driven by said lock member to move said first locking element in a reciprocating manner so as to hold said first leg in said lock body at said shackle unlocking state and drive said first locking portion to detach from said first leg to enable said first leg to separate from said lock body at said shackle unlocking state, wherein said lock body has an upper portion and a lower portion downwardly extended from said upper end, wherein said upper portion has a first receiving chamber for receiving said lock member therein, wherein said lock member comprises a housing for driving said first locking element to move to release said first leg of said shackle from said lock body.

2. The combination lock, as recited in claim 1, wherein said driving disc comprises a driving body and said driving opening is formed through said driving body from top to bottom to define a blocking side and a sliding side of said driving body, wherein when said unlocking element falls into said driving opening, said unlocking element is adapted to be blocked by said blocking side and slide along said sliding side to separate said unlocking element from said driving opening such that when said driving disc rotates to enable said blocking side to move against said unlocking element, said driving disc is able to drive said unlocking element and said lock member to rotate, when said driving disc rotates to enable said sliding side to move against said unlocking element, said driving disc is able to push said unlocking element to separate from said driving opening.

3. The combination lock, as recited in claim 2, wherein said lock member further comprises an elastic element, and said housing of said lock member further comprises a side wall extended between said upper end and said lower end, wherein said side wall has an outer side, wherein said elastic element is provided on said outer side of said side wall of said housing and extended from said side wall to said unlocking element, wherein when said driving opening is aligned with said unlocking element, said elastic element is adapted to push said unlocking element to fall into said driving opening to enable said driving disc to drive said unlocking element and said housing of said lock member to rotate, wherein said outer side of said side wall has a curved surface, and said elastic element is an elastic sheet having a corresponding curved shape such that said elastic element is provided along said curved surface of said outer side of said side wall of said housing.

4. The combination lock, as recited in claim 3, wherein said elastic sheet is a spiral spring sheet, wherein said unlocking element comprises a positioning portion pivotally provided between said upper end and said lower end and a blocking rib provided with said positioning portion and adapted to fall into said driving opening of said driving disc and be blocked by said blocking side of said driving body, wherein said positioning portion has an curved outer surface such that said spiral spring sheet is provided along said curved outer surface of said positioning portion.

5. The combination lock, as recited in claim 4, wherein said lock member further comprises a driving shaft and said lower end of said housing has a shaft hole, wherein said driving shaft comprises a received portion received rotatably within said second receiving chamber and a driving portion downwardly extended from said received portion, wherein said driving disc is fixed with said received portion of said driving shaft and held within said second receiving chamber by said lower end of said housing, and said driving portion is adapted to pass through said shaft hole of said lower end.

6. The combination lock, as recited in claim 5, wherein said disc unit further comprises a plurality of driven discs respectively and orderly provided between said upper end and said driving disc, wherein each of said plurality of driven discs is rotatably coupled with said received portion of said driving shaft, wherein each of said plurality of driven discs has a notch adapted to align with said driving opening, and said driving disc is adapted for orderly driving said driven discs to rotate to enable said notch of each of said plurality of driven discs to align with said driving opening so as to define an unlocking slot for receiving said blocking rib of said unlocking element therein.

7. The combination lock, as recited in claim 6, wherein said driving disc further comprises a first driving pin, and each of said plurality of driven discs comprises a driven body, a driven pin and a second driving pin, wherein said driving body has a first driving side, and said driven body has a driven side and a second driving side, wherein said first driving pin of said driving disc is provided on said driven side, said driven pin of said driven disc is provided on said driven side, said second driving pin of said driven disc is provided on said second driving side, wherein said first driving pin of said driving disc is adapted to couple with said driven pin of said driven disc next to said driving disc, wherein every two neighboring driven discs comprise an upper driven disc and a lower driven disc, and said second driving pin of said lower driven disc is adapted to couple with said driven pin of said upper driven disc such that when said driving disc rotates, said first driving pin of said driving disc is able to meet said driven pin of said driven disc next to said driving disc, and said second driving pin of said lower driving disc of said two neighboring driven discs is able to meet said driven pin of said upper driven disc of said two neighboring driven discs and orderly drive each of said plurality of driven discs to rotate so as to respectively align said notch of each of said plurality of driven discs with said driving opening to define said unlocking slot for said unlocking element.

8. The combination lock, as recited in claim 7, wherein said driving disc and said driven disc said driving disc define a first distance of L1 therebetween, wherein said first driving pin of said driving disc has a height of H1, and said driven pin of said driven disc has a height of H2, wherein said first distance of L1 is less than the total length of H1 and H2 such that when said driving disc rotates, said first driving pin is able to meet said driven pin and rotate said driven pin so as to rotate said driven disc, wherein said lock member further comprises a pressed spring provided between said upper end and said driven disc to press said driven disc so as to hold said driven disc and said driving disc at a position.

9. The combination lock, as recited in claim 8, wherein said housing of said lock member further comprises a driving gear, and said upper end of said housing has a top side, wherein said driving gear is provided on said top side of said upper end for driving said first locking element to move in a reciprocating manner between said shackle locking state and said shackle releasing state, wherein said first driven portion of said first locking element comprises a toothed end side adapted to be engaged with said driving gear such that when said lock member rotates, said driving gear is able to drive said first locking element to move between said shackle locking state and said shackle releasing state.

10. The combination lock, as recited in claim 9, wherein said upper portion has an inner side and a resetting cavity provided in said inner side and communicatedly connected with said first receiving chamber, wherein said resetting cavity is shaped and sized to be adapted to receive said unlocking element therein, wherein said unlocking element is directed to said resetting cavity of said lock body such that when each of said notches of said driven discs is aligned with said driving opening to define said unlocking slot, said unlocking element is forced to leave from said resetting cavity and fall into said unlocking slot by said elastic element, when said unlocking element is pushed by said driving disc to separate from said driving opening, said unlocking element is adapted to reset into said resetting cavity and is held at a position by said inner side of said upper portion of said lock body.

11. The combination lock, as recited in claim 10, wherein said lower portion has an operating inlet direct to said driving portion of said driving shaft to enable said driving shaft to be driven to rotate, wherein said driving portion of said driving shaft comprises an operating end, wherein said operating end passes through said operating inlet and protrudes from said first receiving chamber.

12. The combination lock, as recited in claim 11, further comprising a stopping panel provided in said lock body and a stopping pin provided on said top side of said upper end of said housing, wherein said stopping panel comprises a stopping body adapted to be received in said first receiving chamber and coupled with said upper end of said housing and a stopping protrusion outwardly extended from said stopping body, wherein said stopping protrusion is adapted to be received in said resetting cavity, wherein said stopping body has a bottom side and an arc-shaped slot provided in said bottom side of said stopping body, and said stopping pin is adapted to be received in said arc-shaped slot and slide along said arc-shaped slot so as to limit said lock member to rotate in a predetermined angle range.

13. The combination lock, as recited in claim 12, further comprising a second locking element movably coupled with said lock member and adapted to be driven by said lock member to move in a reciprocating manner between said shackle locking state and said shackle releasing state, wherein when said shackle is at said shackle locking state, said second locking element is capable of holding said second leg, when said shackle is at said shackle unlocking state, said second locking element is driven to leave from said second leg of said shack, wherein said second locking element comprises a second locking portion adapted to be engaged with said second leg of said shackle and a second driven portion extended from said second locking portion to said lock member and adapted to be driven by said lock member to move said second locking element in a reciprocating manner so as to hold said second leg at said shackle unlocking state, and leave from said second leg at said shackle unlocking state.

14. The combination lock, as recited in claim 13, wherein said lock member is rotatably provided within said lock body, and said second locking element is movably provided within said lock body, wherein when said lock member rotates, said second driven portion is driven by said lock member to move said second locking element so as to hold said first leg in said lock body at said shackle unlocking state and drive said second locking portion to leave from said second leg to enable said second leg to separate from said lock body at said shackle unlocking state, wherein said second driven portion of said second locking element is adapted to engage with said driving gear and be driven by said driving gear to move in a reciprocating manner between said shackle locking state and said shackle releasing state, wherein said second driven portion of said second locking element comprises a toothed end side adapted to engaged with said driving gear such that when said lock member rotates, said driving gear is able to drive said second locking element to move in a reciprocating manner between said shackle locking state and said shackle releasing state.

15. The combination lock, as recited in claim 14, further comprising a coding wheel provided between said lower end of said housing and said lower portion of said lock body and rotatably coupled with said driving portion of said driving shaft, wherein said coding wheel is driven by said driving portion of said driving shaft to rotate, wherein said coding wheel has a reading side facing said lower portion of said lock body, wherein said lock body has a laser hole through said lower portion of said lock body, and a laser beam is able to shine on said reading side of said coding wheel through said laser hole.

16. The combination lock, as recited in claim 15, wherein said coding wheel has a plurality of coding openings and a plurality of coding portions, wherein said coding portions are separated from each other by said coding openings in a staggered manner so as to define a coding pattern, wherein said coding pattern is adapted to be obtained by scanning said coding side, wherein said coding pattern is adapted for coding a rotary motion of said driving shaft for unlocking said combination lock.

17. The combination lock, as recited in claim 16, wherein when said coding wheel is driven to rotate, said laser scanner scans said reading side of said coding wheel to obtain said coding pattern of said coding wheel, such that said coding pattern is transmitted to said controller to control said motor to rotate said driving shaft depending on said coding pattern of said coding wheel so as to unlock said combination lock.

* * * * *